US006807742B2

(12) United States Patent
Schick et al.

(10) Patent No.: US 6,807,742 B2
(45) Date of Patent: Oct. 26, 2004

(54) REFLEX SIGHT WITH MULTIPLE POWER SOURCES FOR RETICLE

(75) Inventors: Darin W. Schick, Livonia, MI (US); Glyn A. J. Bindon, Homer, AK (US)

(73) Assignee: Trijicon, Inc., Wixom, MI (US)

( * ) Notice: Subject to any disclaimer, the term of this patent is extended or adjusted under 35 U.S.C. 154(b) by 169 days.

(21) Appl. No.: 10/236,150

(22) Filed: Sep. 6, 2002

(65) Prior Publication Data

US 2004/0047586 A1 Mar. 11, 2004

(51) Int. Cl.[7] ..... F41G 1/34
(52) U.S. Cl. ..... 33/297; 42/131
(58) Field of Search ..... 33/297, 298; 42/111, 42/113, 122, 123, 130, 131, 132; 359/353, 354

(56) References Cited

U.S. PATENT DOCUMENTS

| | | | | |
|---|---|---|---|---|
| 2,392,122 A | | 1/1946 | Dake | |
| 2,780,130 A | | 2/1957 | Mauer | |
| 3,121,163 A | | 2/1964 | Rickert | |
| 3,313,026 A | | 4/1967 | Akin, Jr. | |
| 3,320,671 A | | 5/1967 | Rickert et al. | |
| 3,556,666 A | | 1/1971 | Lichtenstern | |
| 3,641,676 A | | 2/1972 | Knutsen et al. | |
| 3,645,635 A | | 2/1972 | Steck | |
| 3,678,590 A | | 7/1972 | Hayward | |
| 3,880,529 A | | 4/1975 | Althause et al. | |
| 3,897,158 A | | 7/1975 | Steck, III | |
| 3,905,708 A | | 9/1975 | Steck, III | |
| 3,932,162 A | | 1/1976 | Blankenship | |
| 3,938,875 A | * | 2/1976 | Ruder | 42/113 |
| 3,942,901 A | | 3/1976 | Ekstrand | |
| 4,030,203 A | | 6/1977 | Ackerman, Jr. | |
| 4,057,322 A | | 11/1977 | Kao | |
| 4,070,763 A | | 1/1978 | Carts, Jr. | |
| 4,076,645 A | | 2/1978 | Vega | |
| 4,090,778 A | | 5/1978 | Phillips et al. | |
| 4,113,346 A | | 9/1978 | Jackson et al. | |
| 4,119,362 A | | 10/1978 | Holzman | |
| 4,313,843 A | | 2/1982 | Bollyky et al. | |
| 4,381,882 A | | 5/1983 | Sabine | |
| 4,417,814 A | | 11/1983 | Doliber | |
| 4,576,451 A | | 3/1986 | Tominaga | |
| 4,665,622 A | * | 5/1987 | Idan | 42/113 |
| 4,678,608 A | | 7/1987 | Dugliss | |
| 4,695,126 A | | 9/1987 | Cook | |
| 4,717,511 A | | 1/1988 | Koroscil | |
| 4,738,508 A | | 4/1988 | Palmquist | |
| 4,743,765 A | | 5/1988 | Ekstrand | |
| 4,764,011 A | * | 8/1988 | Goldstein | 42/113 |
| 4,790,641 A | | 12/1988 | Halldorsson | |
| 4,806,007 A | * | 2/1989 | Bindon | 42/122 |
| 4,877,324 A | * | 10/1989 | Hauri et al. | 42/113 |
| 4,968,109 A | | 11/1990 | Tanaka | |
| 4,993,833 A | * | 2/1991 | Lorey et al. | 42/113 |
| 4,998,795 A | | 3/1991 | Bowen et al. | |

(List continued on next page.)

FOREIGN PATENT DOCUMENTS

| | | |
|---|---|---|
| CH | 318892 | 3/1957 |
| DE | 4226203 A1 | 2/1994 |
| EP | 0259837 | 3/1988 |
| EP | 02100202 | 12/1990 |
| GB | 2233785 | 1/1991 |
| JP | 64-29827 | 1/1989 |
| WO | WO97/00419 | 1/1997 |

*Primary Examiner*—G. Bradley Bennett
(74) *Attorney, Agent, or Firm*—Harness, Dickey & Pierce, P.L.C.

(57) ABSTRACT

A reflex sighting device for day and night sighting including an ambient light collector assembly and sources of artificial light for providing illumination for a reticle pattern for sighting and with at least one of the sources of artificial light being electrically powered and having a control system for controlling its operation and with separately unique illumination structures and combinations.

48 Claims, 19 Drawing Sheets

U.S. PATENT DOCUMENTS 5,013,110 A 5/1991 Marazzi
5,054,225 A 10/1991 Giuffre et al.
5,062,682 A 11/1991 Marazzi
5,065,519 A 11/1991 Bindon
5,084,780 A * 1/1992 Phillips ..... 359/353
5,088,804 A 2/1992 Grinderslev
5,122,306 A 6/1992 Van Moer et al.
5,223,650 A 6/1993 Finn
5,301,250 A 4/1994 Cheng
5,333,218 A 7/1994 Ortiz, Jr.
5,345,323 A 9/1994 Basavanhally et al.
5,351,327 A 9/1994 Lurie et al.
5,359,800 A 11/1994 Fisher et al.
5,426,715 A 6/1995 Moisson et al.
5,434,704 A * 7/1995 Connors et al. ..... 42/123
5,448,662 A 9/1995 Kittell et al.
5,452,131 A 9/1995 Jorlov
5,456,035 A 10/1995 Stiles
5,459,806 A 10/1995 Hultermans
5,465,314 A 11/1995 Jie et al.
5,483,362 A 1/1996 Tai et al.
5,493,450 A 2/1996 Ekstrand
5,500,911 A 3/1996 Roff
5,653,034 A * 8/1997 Bindon ..... 33/297
5,711,104 A 1/1998 Schmitz
5,924,234 A 7/1999 Bindon et al.
6,014,830 A 1/2000 Brown et al.
6,041,508 A 3/2000 David
6,601,308 B2 * 8/2003 Khoshnood ..... 42/132

* cited by examiner

REFLEX SIGHT WITH MULTIPLE POWER SOURCES FOR RETICLE

FIELD OF THE INVENTION

The present invention relates to an optical sighting device for day or night sighting and more particularly to a reflex sighting device with multiple power sources for illumination of the reticle under different lighting conditions on the object being viewed.

BACKGROUND OF THE INVENTION

As will be seen, the present invention incorporates some of the concepts in the U.S. Pat. No. 5,653,034 issued Aug. 5, 1997 to Glyn A. J. Bindon for "Reflex Sighting Device For Day And Night Sighting" and thus the disclosure of that patent should be considered as relevant background for the present invention. As noted in the '034 Patent, reflex sights are well-known and have taken a variety of forms, such as in gun sights and camera view finders. In substantially all forms, however, some type of reticle pattern is utilized to mark the area or object of interest. Light or the illuminated image from this reticle pattern is reflected from a semi-transparent, semi-reflective mirror or lens surface through which the object or field is viewed. The curvature of the semi-reflecting surface is such as to direct the reflected rays of the reticle image to converge approximately at the same viewing point of the operator as the transmitted rays of the object or field being sighted and thereby to make the reticle pattern appear at infinity and superimposed upon the object or field and at approximately the same distance.

In accordance with the present invention there is provided a reflex sight comprising a reticle and a dichroic beam-splitting mirror for combining rays of light from the reticle with rays of light from an object or field. The dichroic mirror has high reflectance in one part of the visible spectrum and high transmittance in the other parts to provide the dual image to the viewer or operator.

It has been found that in using sighting devices, for example for aiming weapons, cameras and the like, that sighting with both eyes open is advantageous. When sighting with both eyes open, the operator has the benefit of binocular vision which increases the field of view, provides depth perception information, increases contrast sensitivity and assists the sense of balance. The assessment of the speed and direction of moving objects is also more accurate.

As noted, frequently a dichroic mirror is utilized in reflex sights. Such a dichroic mirror reflects nearly all light above one wavelength and transmits nearly all light below that wavelength. If a red or orange dot is used as the aiming mark or reticle, the mirror will reflect red/orange light and transmit yellow, green and blue light from the object being viewed. Thus the dichroic mirror changes the color of a target scene. If the target is viewed with one eye only, the loss of the red color from the target area will be observed. When the other eye is opened, the missing color will be put back into the target scene perceived by the viewer or operator.

Regardless of the type of sighting device, however, it is desirable to provide a limited contrast between the level of brightness of the reticle and that of the target or scene. However, for day and night sighting, the aiming mark contrast can be inconsistent. For example if the aiming mark or reticle is extremely bright it may be most suitable for aiming at brightly lit target scenes but could be too bright for dimly lit target scenes and, of course, the reverse is also true.

Thus aiming at a dark object in heavy shade can be difficult or inaccurate without a suitable means to improve the level of contrast of the aiming mark or reticle. In the past, numerous ways have been devised whereby the aiming mark brightness can be varied to improve contrast with the target scene, i.e. battery powered LEDs (light emitting diodes), etc. which are controlled manually or electronically.

In the present invention a unique construction is utilized to provide selective variation in the reticle brightness in proportion to the target scene brightness in day and night sighting while providing an illumination intensity for day sighting which provides a desired contrast comparable to that of an artificial light source for night sighting.

A fiber optic structure is utilized in which a fiber optic light collector receives ambient light focused transversely or radially inwardly over a selected length of fiber whereby a desired magnitude of light energy can be gathered from ambient light to provide illumination to the reticle. In addition a radio-luminescent source, such as a tritium lamp, is used in combination with the fiber optic collector resulting in a combined illumination whereby a desired level of illumination can be provided to the reticle over the full range of brightness during day and night sighting. At the same time an LED is provided with a variable power source, including a battery, for selectively varying the brightness. In addition a power source, such as a photochemical light source, is provided for selective illumination of the reticle as a back-up for the LED light source in the event of battery failure or other failure of the LED light source.

The LED will not necessarily be continuously energized if the reticle is adequately illuminated by the tritium lamp or by the ambient light being collected. In this regard the present invention utilizes a control system which includes a power controller actuable by the operator for selectively varying the magnitude of voltage and hence power to the LED whereby the intensity of light emitted can be adjusted by the operator. In addition the control system includes a monitor which senses the magnitude of the battery voltage and provides a visual signal to the operator when the voltage falls below a preselected magnitude indicating need to replace it while it is still at an operative level. In addition, however, in the event of loss of sufficient intensity from the tritium lamp source, the LED can be actuated as a back-up to compensate.

The control system also includes a memory structure which will store and remember the magnitude of the battery voltage applied to the LED and resultant level of reticle illumination created before the unit is turned off. Now when the unit is turned on again the magnitude of voltage and hence resultant level of reticle illumination will be at the last level set. Also in the event the system was temporarily disabled by a battery failure or disengagement, upon replacement the magnitude of voltage applied and thus intensity of the illumination to the reticle will be automatically initiated at a level at about the setting for the lowest level of daylight illumination.

In addition, the level of the magnitude of battery voltage applied to the LED will be selectively set by the operator in fixed, stepped increments. Also each activation for a step up or down in voltage magnitude as applied by the operator will be signaled by a short flash or blink of the light of the reticle.

It should also be noted that the magnitude of illumination provided by the tritium lamp can be varied by utilizing a manually variable cover to block more or less intensity of light transmission to the reticle.

Thus it is an object of the present invention to provide a unique reflex sighting device for day and night sighting.

It is another object of the present invention to provide a unique reflex sighting device with improved illumination for the reticle.

It is still another object of the present invention to provide a unique reflex sighting device in which the illumination of the reticle in certain instances is varied naturally in accordance with the illumination of the target or viewing area by an ambient light collector of a unique construction.

It is another object of the present invention to provide a unique reflex sighting device for day and night sighting and including multiple power sources for illumination of the reticle.

It is another object of the present invention to provide a unique reflex sighting device for day and night sighting and including multiple power sources for illumination of the reticle and with at least one of the power sources being operable by the operator for selectively varying the intensity of the illumination of the reticle.

It is another object of the present invention to provide a unique reflex sighting device for day and night sighting and including multiple power sources for illumination of the reticle and with at least one of the power sources being a battery powered LED and including a back-up power source selectively actuable by the operator in the event of failure of the battery;

It is another object of the present invention to provide a unique reflex sighting device for day and night sighting and including multiple power sources for illumination of the reticle and with at least one of the power sources being a battery powered LED and including a memory system for automatically placing the LED at a preselected intensity level upon activation of the LED;

It is another object of the present invention to provide a unique reflex sighting device for day and night sighting and including multiple power sources for illumination of the reticle and with at least one of the power sources being a battery powered LED and including a monitor for providing a signal to the operator in the event the voltage drops below a preselected level to provide an advance warning for battery replacement prior to failure;

Other objects, features and advantages of the present invention will become apparent from the subsequent description and the appended claims, taken in conjunction with the accompanying drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention. It should also be understood that certain unique features can be considered independently of the numerous combinations noted.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
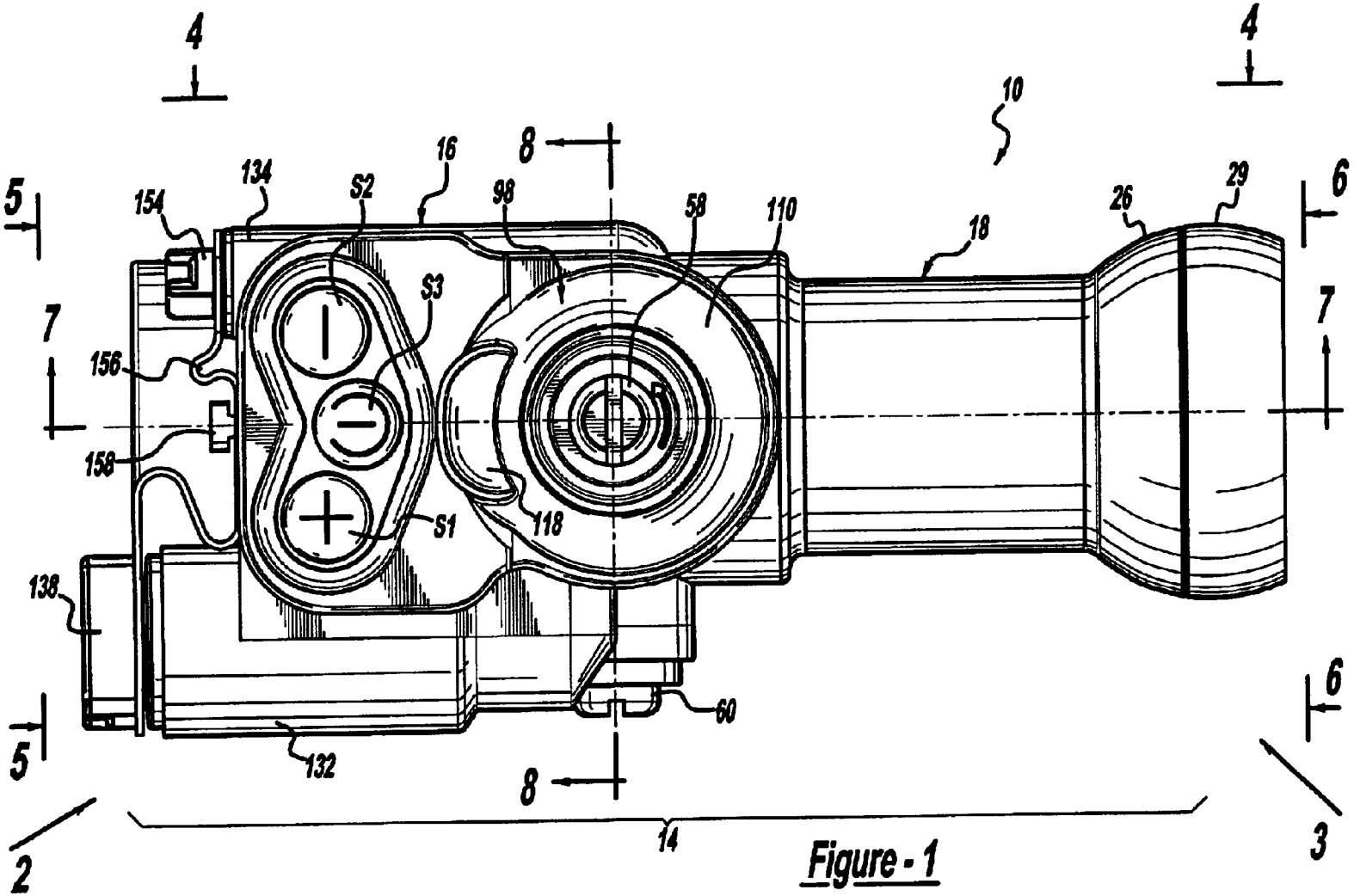
FIG. 1 is a top elevational view of a sighting device of the present invention.

The following description of the preferred embodiment(s) is merely exemplary in nature and is in no way intended to limit the invention, its application, or uses.

It will be seen from the description which follows that the reflex sighting device of the present invention utilizes a light collector assembly having a fiber optic structure designed to gather a significant, quantity of the available ambient light. The light collected by the fiber optic structure is then transmitted to a reticle defining structure which is located to transmit a reticle image or pattern onto a dichroic lens or mirror. In addition, further illumination of the reticle structure is provided by multiple sources of artificial light such as a tritium lamp and battery powered LED. The illumination from the light collector assembly is provided primarily for day sighting while the illumination from the tritium lamp is primarily for night sighting while the LED can be selectively applied and controlled for night or low light conditions or for bright light conditions to be described. All of these sources of illumination can be applied to the reticle defining structure at the same time in which case the illumination from the LED will be the greatest, except when the fiber collector is in direct sunlight. Since it is desired that the level of illumination of the reticle pattern be a function of the level of illumination of the object or scene being viewed through the sight in day sighting the magnitude of illumination from the tritium lamp will be considerably less than that from the collector assembly. Thus in a bright daylight condition the level of reticle illumination will be determined primarily by the light collector assembly while night illumination will be primarily determined by the tritium lamp. In this regard see the '034 Patent noted above. The magnitude of illumination of the tritium lamp can be made selectively adjustable by imposing a movable cover or shield between the lamp and the light conductor fiber to permit manually selective attenuation or blockage of the illumination from the lamp. As previously noted it is desirable to have the level of illumination of the reticle varied in accordance with the level of illumination of the object or scene being viewed while at the same time providing the desired degree of contrast. The level of illumination from the collector assembly with its fiber optic structure will vary naturally in accordance with the ambient daylight illumination and in this regard will be balanced with a known level of illumination provided by the artificial light source. At the same time the battery operated LED can be actuated by the operator with a control to selectively vary the intensity of illumination to the reticle. This can be especially significant in situations where the level of ambient light is low or dark but the target or object being viewed is brightly illuminated. For example this can occur when the target or object or surrounding area is illuminated with a flashlight or other artificial light source. Now the brightness of the reticle can be selectively increased by the LED to compensate for the brightness of the viewed object. In addition a photochemical light source can be used as a back-up for the LED.

In addition, as noted, the sighting device of the present invention when utilizing multiple power sources can provide back-up for different contingencies. Thus the LED while provided to be selectively actuable in extreme, bright lighting conditions can also act as a back-up in the event there is a loss of sufficient illumination from the tritium lamp source. Also as noted the photochemical light source is provided as back-up in the event there is a power loss in the LED source.

Looking now to FIGS. 1–8 of the drawings, the reflex sighting device of the present invention is depicted as a gun sight 10 adapted to be mounted on a rifle via a mounting bracket (not shown). The gun sight or sighting device 10 includes a generally elongated housing assembly 14.

The housing assembly 14 includes a cylindrical main housing 16 having an outer housing cylinder 18 connected thereto by a threaded sleeve portion 20 threadably secured in a threaded bore portion 22 at the outer end of the main housing 16. An inner sighting cylinder 24 is pivotally secured within the main housing 16 and the outer housing cylinder 18. In this regard the outer end of the outer housing cylinder 18 terminates in an enlarged hemispherically shaped support section 26. The inner sighting cylinder 24 also has an enlarged hemispherically shaped end section 28 which is matably and pivotably received within the hemispherically shaped support section 26. An end cap assembly 29 is threadably secured to the outer end of the support section 26 to partially overengage the end section 28 to hold it axially in place while permitting pivotal movement of the inner sighting cylinder 24. A beam-splitting dichroic mirror or lens 32 having a circular outer contour is mounted in a mating circular bore portion 34 located in the front of the inner sighting cylinder 24. The dichroic mirror 32 is held in place by a retaining ring 35 threadably secured in a threaded section of the end section 28 of the inner sighting cylinder 24.

An eyepiece, viewing lens 44 is supported at the inner end of the main housing 16 for sighting through the sight 10 by the operator. The lens 44 is held in place through engagement by a circular retaining ring 46 which is threaded into a threaded bore portion 48 at the inner end of the main housing 16.

The operator then will view the target or object in the scene through the viewing lens 44 and the dichroic mirror, lens 32. This is viewed through the sighting cylinder 24. Here the internal surface of the sighting cylinder 24 is machine roughened and/or coated to form a non-reflective surface so as to not interfere with the scene being observed by the operator.

As noted to assist in aiming, a reticle pattern is projected onto the inner surface of the dichroic mirror, lens 32 and is reflected back to the eye of the viewer through the viewing lens 44. Looking now to FIG. 8*a*, a reticle projection structure 40 is supported on the outer surface near the front end of the sighting cylinder 24 and is angled inwardly through a slot 52 to direct the reticle image onto the inner surface of the dichroic mirror, lens 32 along a line X'. The dichroic mirror, lens 32 is constructed and oriented to thereby reflect the reticle image back to the viewing lens 44 substantially at the viewing axis X of the sighting device 10.

It is typical in sighting devices for rifles to provide means to calibrate the sighting device relative to the trajectory of the bullet to compensate for windage and elevation. In the embodiment shown in FIGS. 1–8 of the present invention this is accomplished by a construction in which the sighting cylinder 24 is selectively movable relative to the main housing 16 and outer housing cylinder 18.

Figure 7:
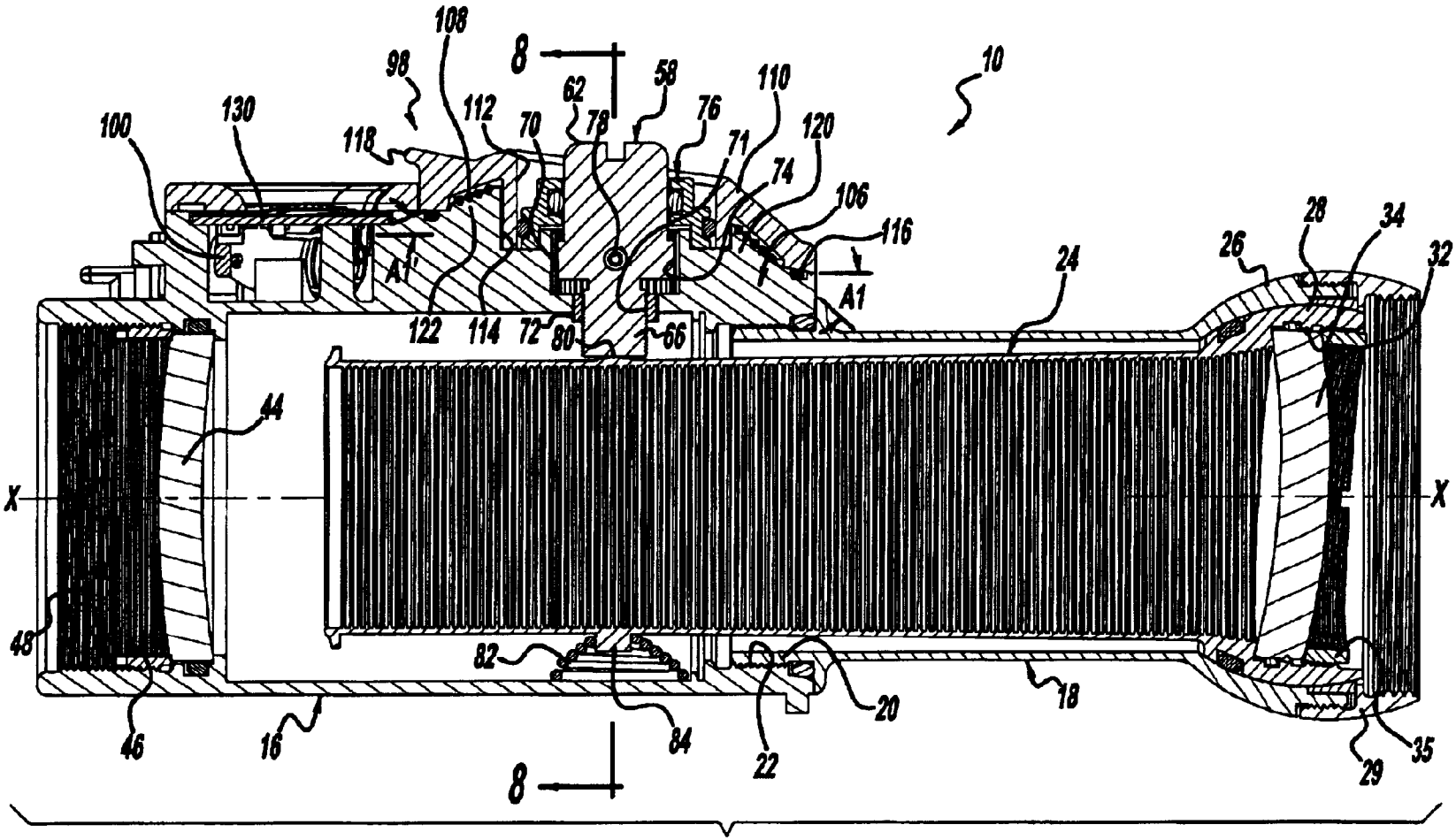
FIG. 7 is a longitudinal sectional view of the sighting device of FIG. 1 taken generally in the direction of the Arrows 7—7 in FIG. 1.
Figure 8:
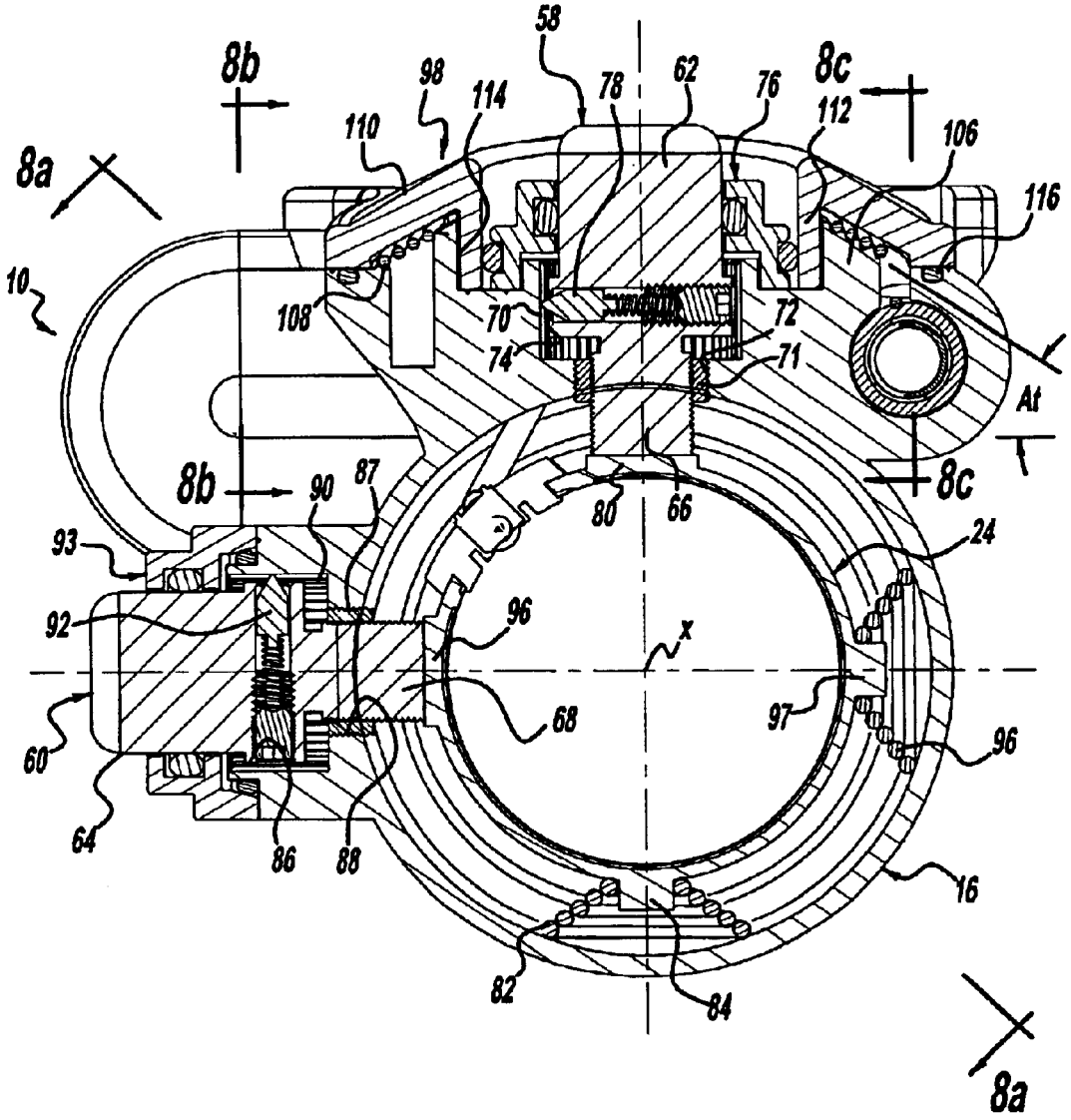
FIG. 8 is a transverse sectional view of the sighting device of FIG. 1 taken generally in the direction of the Arrows 8—8 in FIG. 1.

Looking now to FIGS. 7 and 8, a pair of ratchet bolts 58 and 60 are of a stepped construction having enlarged head portions 62 and 64, respectively, connected to reduced diameter threaded shank portions 66 and 68, respectively. The ratchet bolt 58 is located in a stepped bore 70 at the upper side of the main housing 16 with the threaded shank portion 66 threadably engaged with a threaded metal insert 71 threadably secured in a reduced diameter threaded bore section 72. The head portion 62 extends partially into an enlarged bore portion 74 of the stepped bore 70 and extends outwardly to facilitate gripping by the operator. An annular seal assembly 76 is located over the head portion 62 to provide a seal relative to the inside of the main housing 16. The inner surface of the enlarged bore portion 74 is axially serrated for engagement by a spring biased ratchet pin 78 which extends diametrically through the enlarged head portion 62 of the ratchet bolt 58. The threaded shank portion 66 extends through the threaded bore section 72 and into engagement with a generally axially, arcuate step 80 at the upper end of the sighting cylinder 24. (See FIG. 7). A biasing spring 82 is located within the main housing 16 diametrically opposite from the ratchet bolt 58 and in biasing engagement with the sighting cylinder 24. The spring 82 is generally cone shaped with the reduced diameter upper end secured to the sighting cylinder 24 by engagement with a retaining tab 84 on the sighting cylinder 24.

In a similar manner the ratchet bolt 60 is located in a stepped bore 86 at the side of the main housing 16 in quadrature with the stepped bore 70 with the threaded shank portion 68 threadably engaged with a threaded metal insert 87 threadably secured in a reduced diameter threaded bore section 88. The head portion 64 extends partially into an enlarged bore portion 90 of the stepped bore 86 and also extends outwardly to facilitate gripping by the operator. An annular seal assembly 93 is located over the head portion 64 to provide a seal relative to the inside of the main housing 16. The inner surface of the enlarged bore portion 90 is also axially serrated for engagement by a spring biased ratchet pin 92 which extends diametrically through the enlarged head portion 64 of the ratchet bolt 60. The threaded shank portion 68 extends through the threaded bore section 88 and into engagement with a generally axially, arcuate step 94, similar to step 80, at the confronting end of the sighting cylinder 24. A biasing spring 96 is located within the main housing 16 diametrically opposite from the ratchet bolt 60 and in biasing engagement with the sighting cylinder 24. The spring 96 is also generally cone shaped with the reduced diameter upper end secured to the sighting cylinder 24 by engagement with a retaining tab 97 on the sighting cylinder 24.

To make an up-down or vertical elevational adjustment of the sighting device 10, the ratchet bolt 58 is simply threaded more or less into the stepped bore 70 with the bias of the biasing spring 82 urging the sighting cylinder 24 to be pivoted in the desired up-down direction relative to the main housing 16 and outer housing cylinder 18. The ratchet bolt 58 will rotate with the ratchet pin 78 providing a feel for the indexing movement and an audible or tactile "click" sound or feedback to the operator caused by the ratcheting movement against the serrated, enlarged bore portion 74. The engagement of the ratchet pin 78 with the splines on the serrated bore portion 74 will also provide an anti-rotation function to hold the sighting cylinder 24 in the desired position relative to the main housing 16 and outer housing cylinder 18.

A similar adjustment can be made to make a left-right horizontal or windage adjustment of the sighting device 10. The ratchet bolt 60 is simply threaded more or less into the stepped bore 86 whereby the back of the sighting cylinder 24 will be pivoted transversely, left or right, to the desired position. The bias of the biasing spring 96 will urge the sighting cylinder 24 to the desired transverse position relative to the main housing 16 and outer housing cylinder 18. Again the ratchet bolt 60 will rotate with the ratchet pin 92 providing a feel for the indexing movement and an audible or tactile "click" to the operator for each increment of rotation. Also the engagement of the ratchet pin 92 with the splines on the enlarged serrated bore portion 90 will provide a positive locking action.

The pivotal movement of the sighting cylinder for up and down vertical and left-right windage movement occurs through the engagement of the hemispherical sections 26 and 28 at the front of the outer housing cylinder 18 and inner sighting cylinder 24.

As previously noted the sighting device 10 can be provided with multiple sources of light for providing illumination for transmission of a reticle structure or image to the dichroic mirror, lens 32 for reflection back to the eye of the operator for aiming the sighting device 10 and associated apparatus such as a rifle. In this regard four sources of light can be provided and include an ambient light collector, a tritium lamp, a battery powered LED and a photochemical light source.

Figure 9:
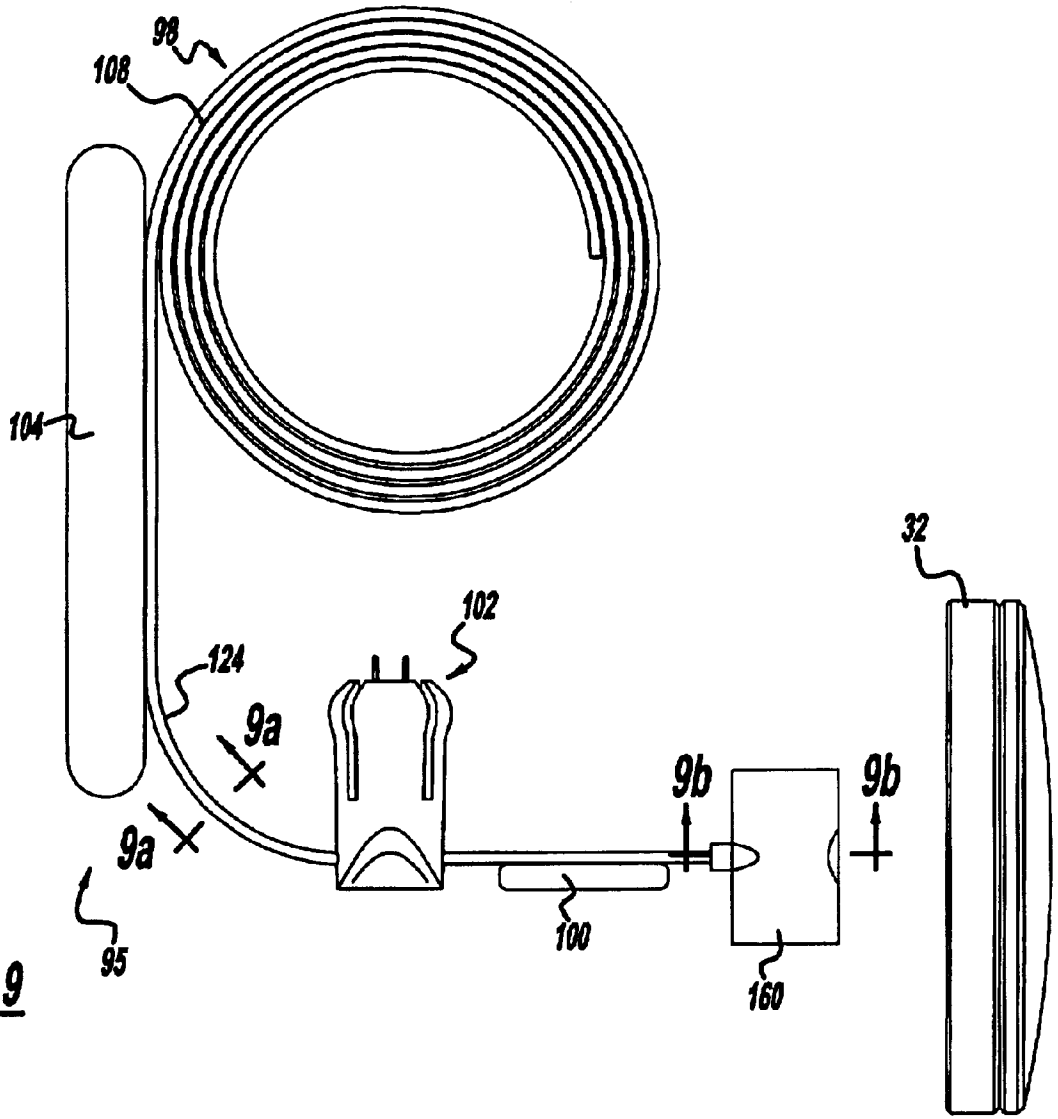
FIG. 9 is a schematic diagram showing a first assembly of light apparatus with multi-lighting sources, including a fiber optic ambient light collector, a light emitting diode, a tritium lamp and a self-luminous photochemical light source, for providing illumination for transmitting a reticle pattern to a dichroic mirror type lens for a sighting device such as in FIGS. 1–8.
Figure 10:
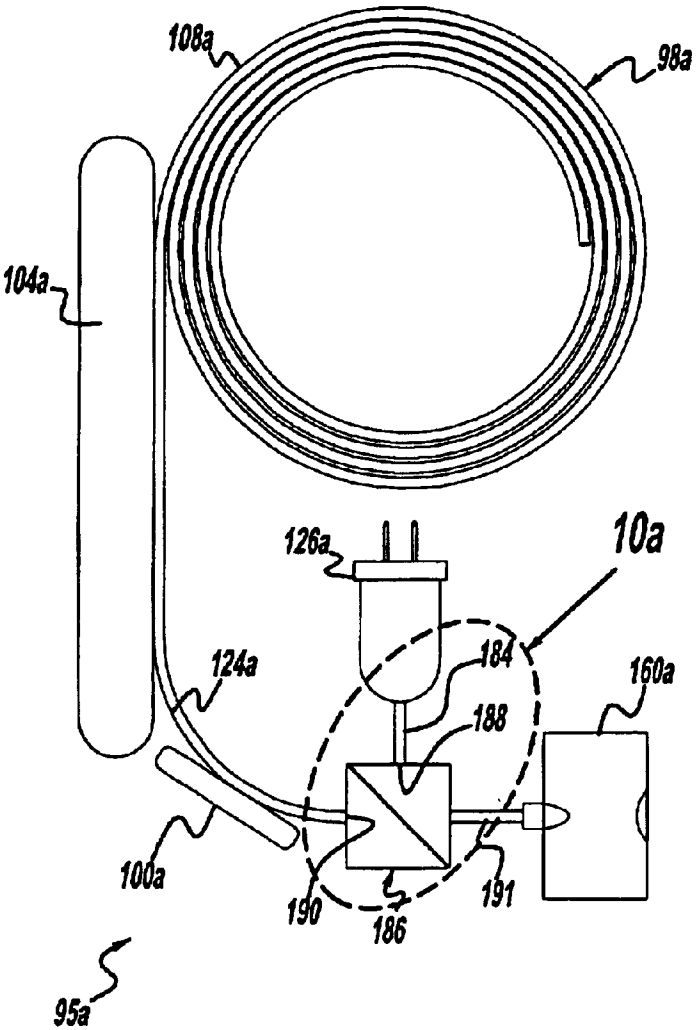
FIG. 10 is a schematic diagram showing a second assembly of light apparatus with multi-lighting sources, including a fiber optic ambient light collector, a light emitting diode, a tritium lamp and a self-luminous photochemical light source, for providing illumination for transmitting a reticle pattern to a dichroic mirror type lens for a sighting device such as in FIGS. 1–8.
Figure 10:
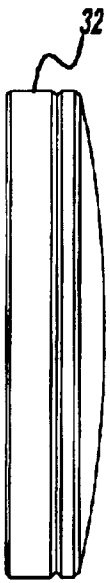
Figure 11:
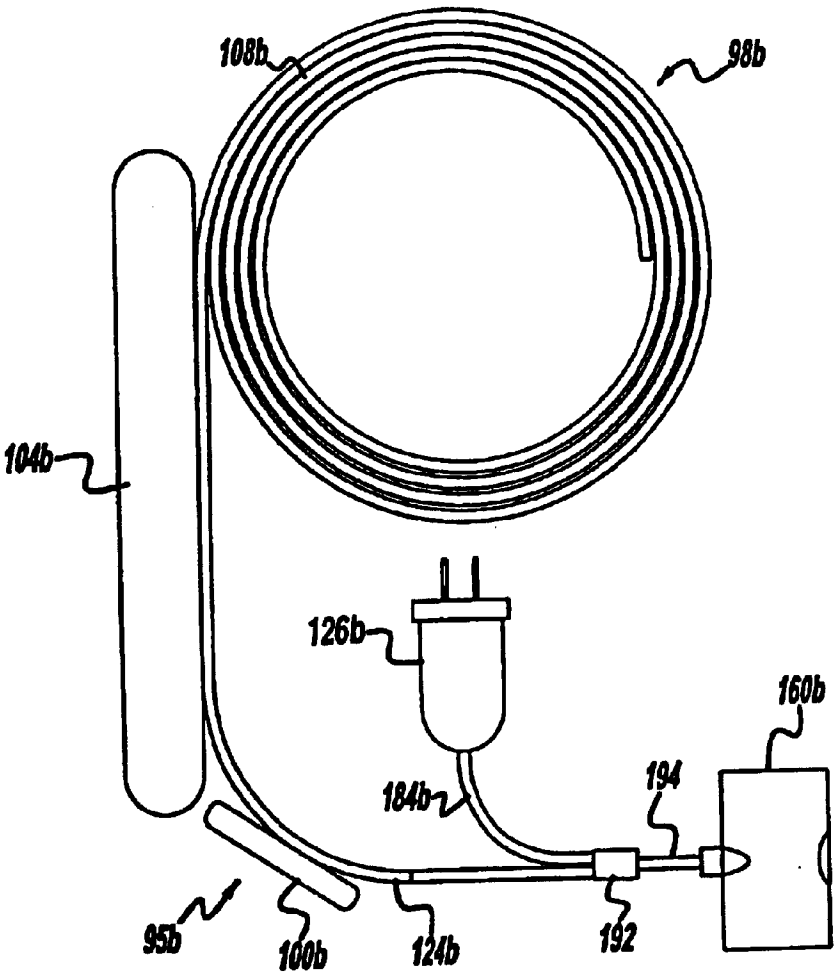
FIG. 11 is a schematic diagram showing a third assembly of light apparatus with multi-lighting sources, including a fiber optic ambient light collector, a light emitting diode, a tritium lamp and a self-luminous photochemical light source, for providing illumination for transmitting a reticle pattern to a dichroic mirror type lens for a sighting device such as in FIGS. 1–8.
Figure 11:
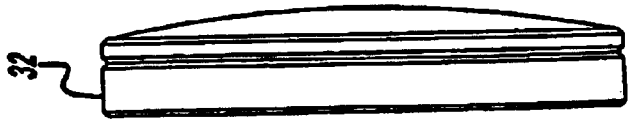

Three different arrangements of the sources of light are shown schematically in FIGS. 9–11. The previously described housing and lens structure is substantially the same for the three arrangements. Looking to FIG. 9, a first assembly 95 of the four light sources includes a fiber optic ambient light collector section 98, a tritium lamp 100, an LED section 102 and a photochemical light source 104.

Looking now to FIGS. 1–9, the light collector section 98 includes a fiber optic collector 108 which is adapted to be located on a generally conical support dome 106 at the upper, forward end of the main housing 16. The light collector section 98 further includes a retainer cover 110 for enclosing the fiber optic collector 108.

The fiber optic collector 108 is formed of an optical fiber which is generally annularly and helically coiled onto and supported on the support dome 106. The support dome 106 is provided with a generally helically stepped structure whereby the optical fiber of the collector 108 will be supported on planar, stepped surfaces. The support dome 106 is generally located around the ratchet bolt 58 and associated stepped bore 70. Thus the fiber optic collector 108 is circled around the ratchet bolt 58 and is generally, conically shaped to mate with the conical surface of the support dome 106. The retainer cover 110 is generally annularly contoured and has a support ring 112 adapted to fit and be secured, as by ultrasonic welding within a counterbore 114 in the main housing 16 around the stepped bore 70.

The annular seal assembly 76 is located in the support ring 112 to provide a seal therewith and is also secured thereon as by ultra sonic welding. An additional seal 116 provides a seal between the outer periphery of the retainer cover 110 and the confronting outer surface of the main housing 16. In this regard, the retainer cover 110 has an upwardly projecting tab 118 at its rearward end to facilitate securing of a cap 119 which is selectively actuable to enclose the retainer cover 110 to block light from the artificial light sources transmitted to and emitted from the fiber optic collector 108. The cap 119 would be used by the operator mainly at night or in a dark environment to inhibit being observed by the light emitted.

Figure 2:
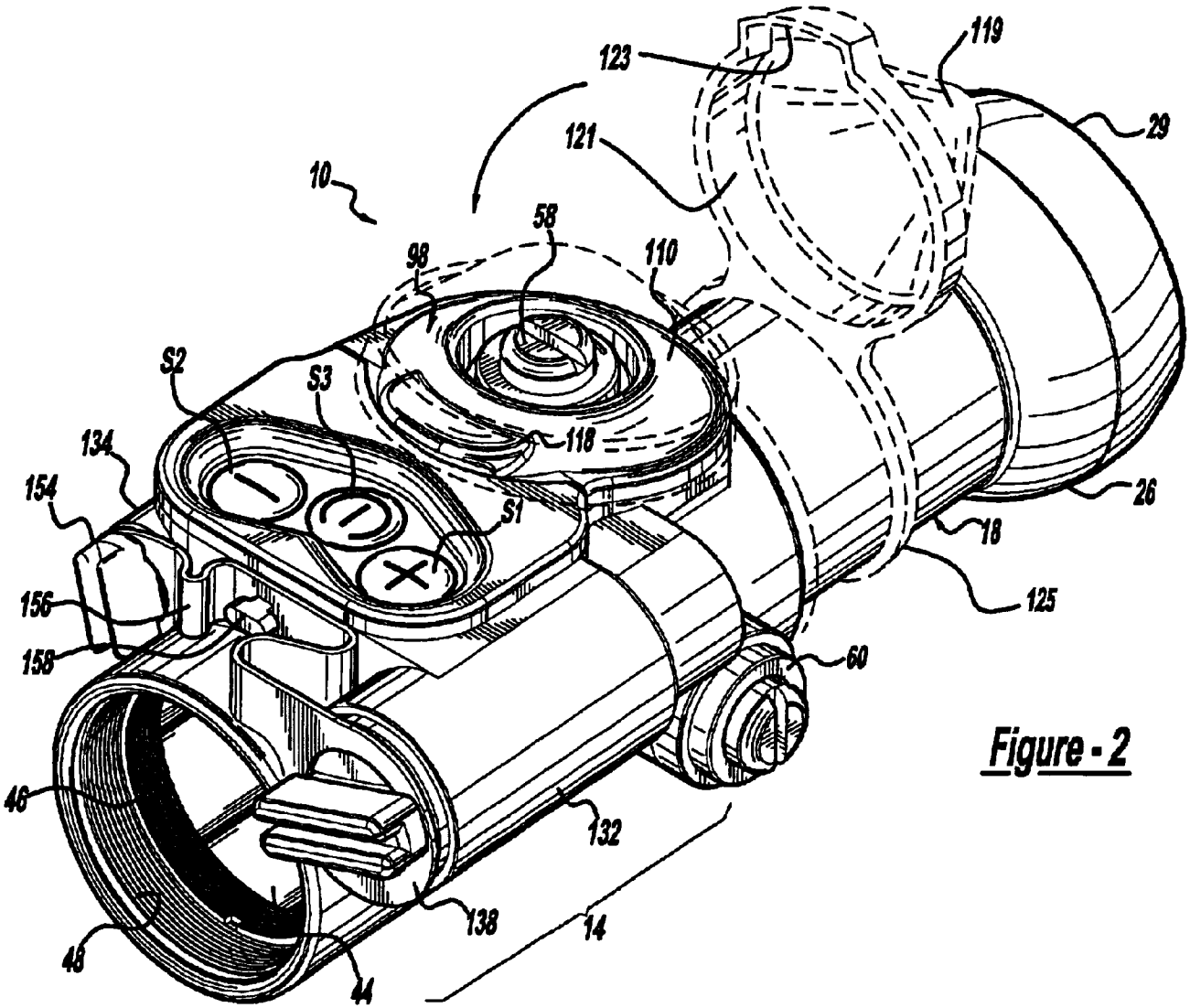
FIG. 2 is a pictorial view of the sighting device of FIG. 1 taken generally in the direction of the Arrow 2 in FIG. 1 and includes a cap shown in phantom which can be selectively applied to cover the ambient light collector.
Figure 3:
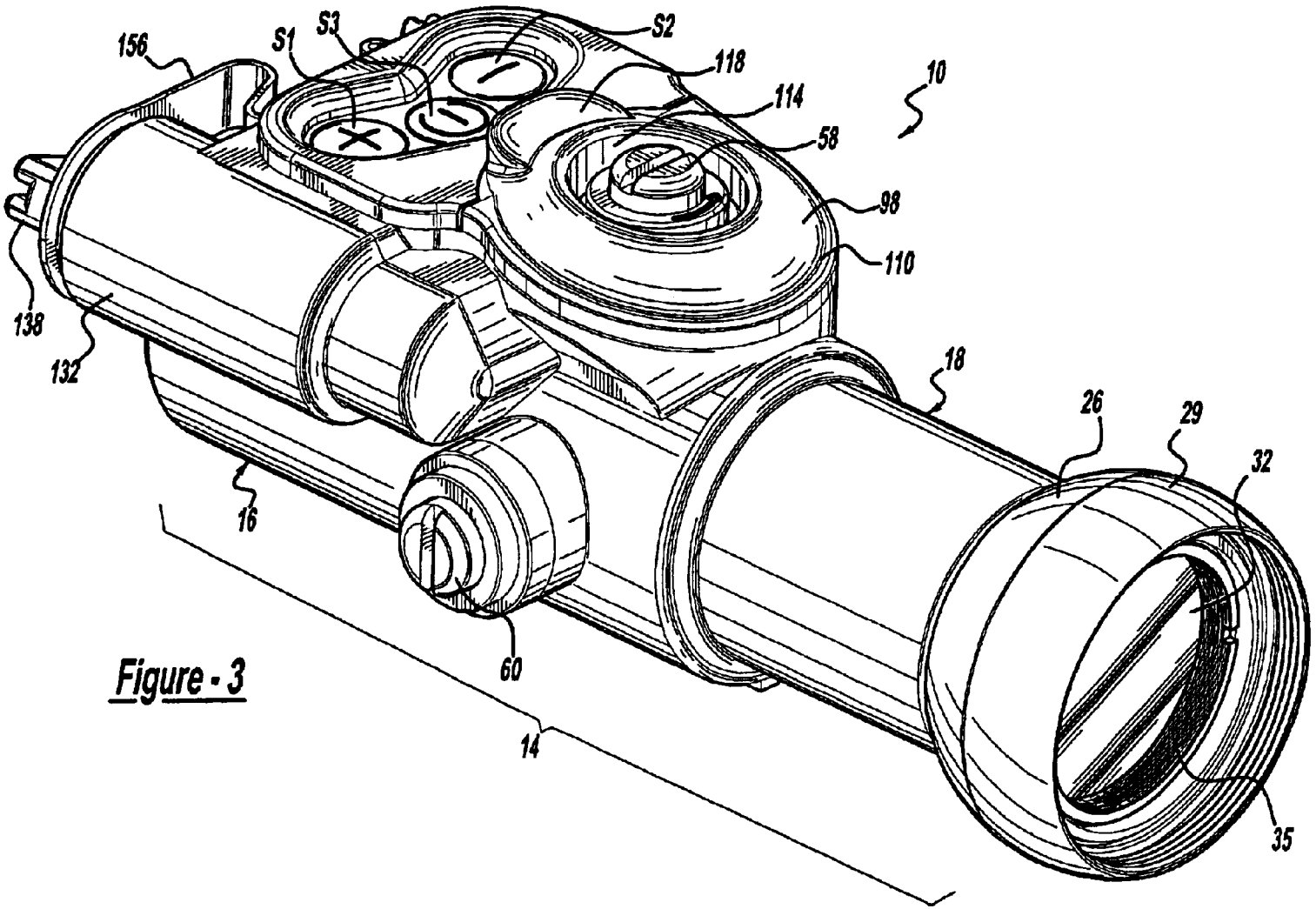
FIG. 3 is a pictorial view of the sighting device of FIG. 1 taken generally in the direction of the Arrow 3 in FIG. 1.
Figure 4:
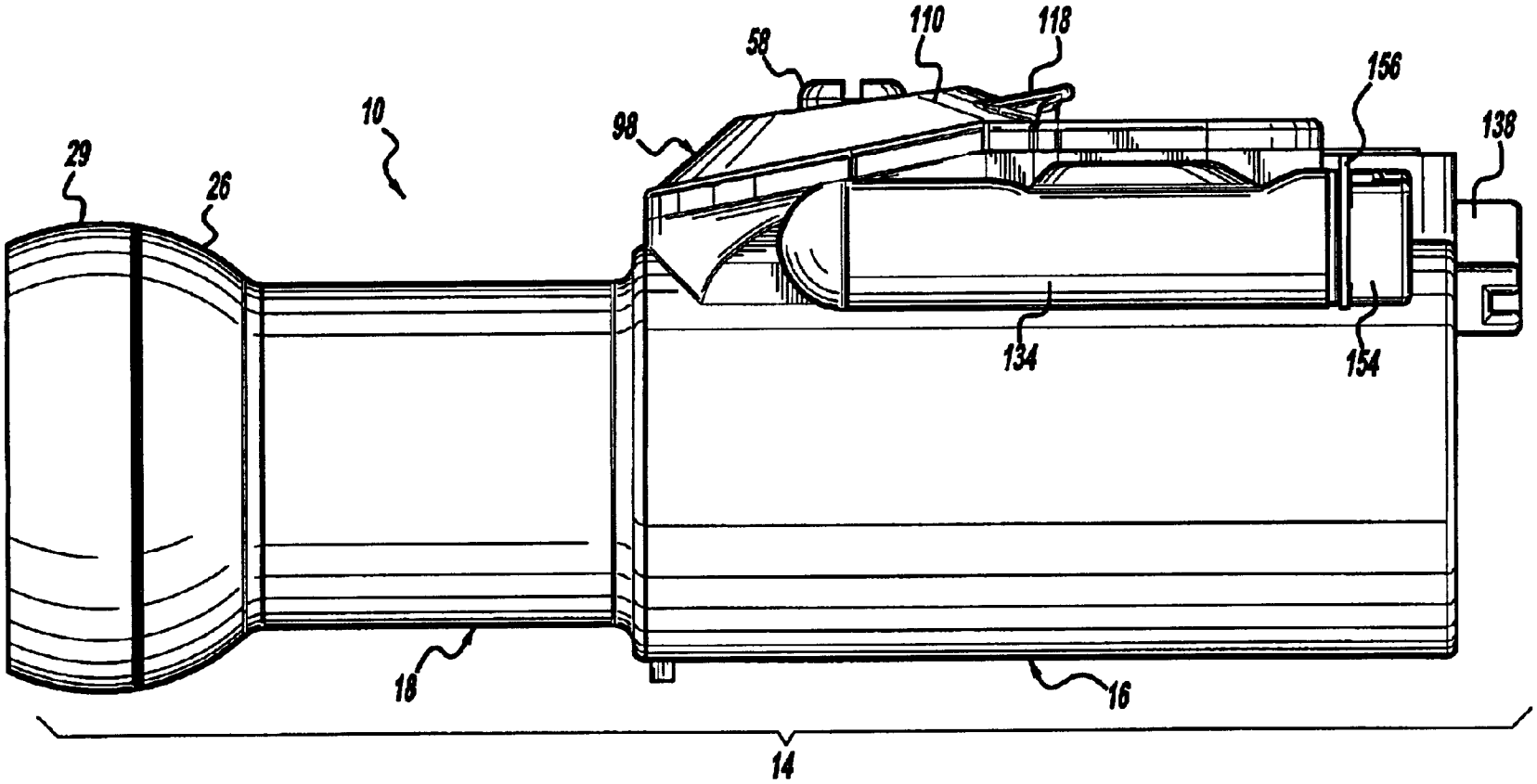
FIG. 4 is a side elevation view of the sighting device of FIG. 1 taken generally in the direction of the Arrow 4 in FIG. 1.
Figure 5:
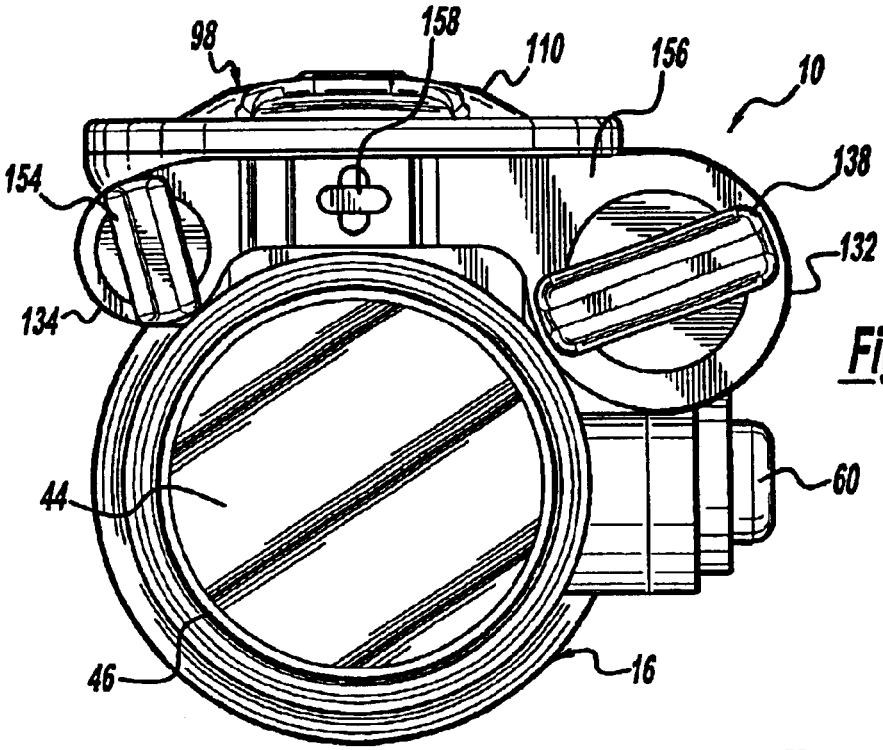
FIG. 5 is an end elevational view of the sighting device of FIG. 1 taken generally in the direction of the Arrow 5 in FIG. 1.
Figure 6:
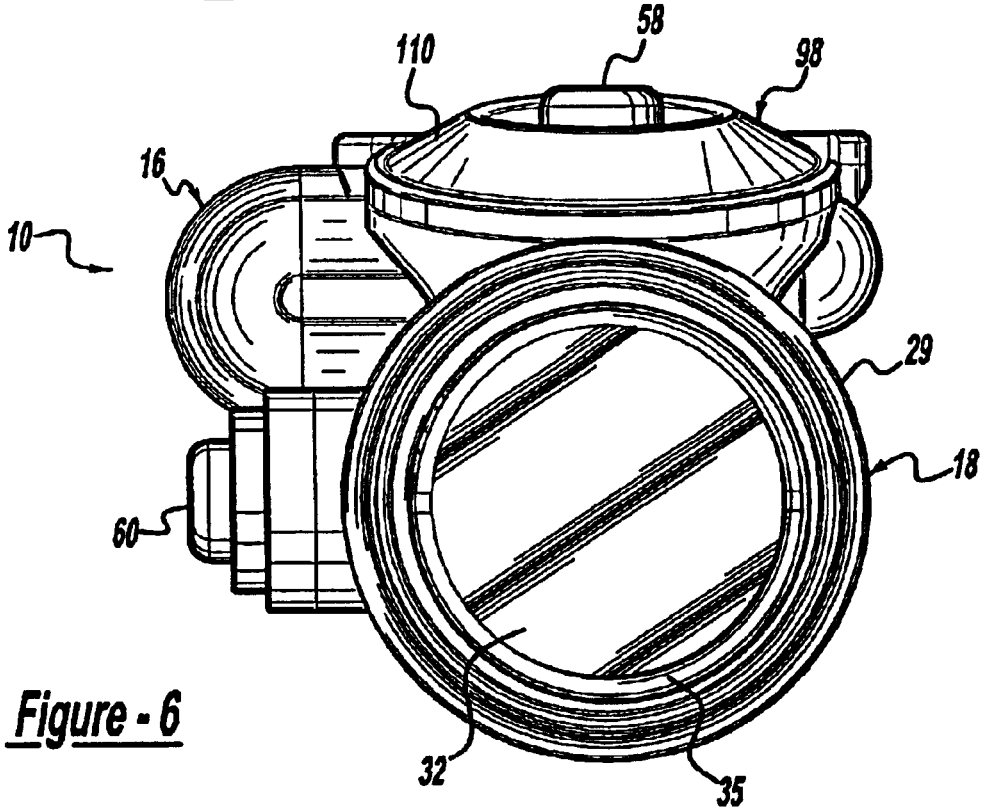
FIG. 6 is an end elevational view of the sighting device of FIG. 1 taken generally in the direction of the Arrow 6 in FIG. 1.
Figure 12A:
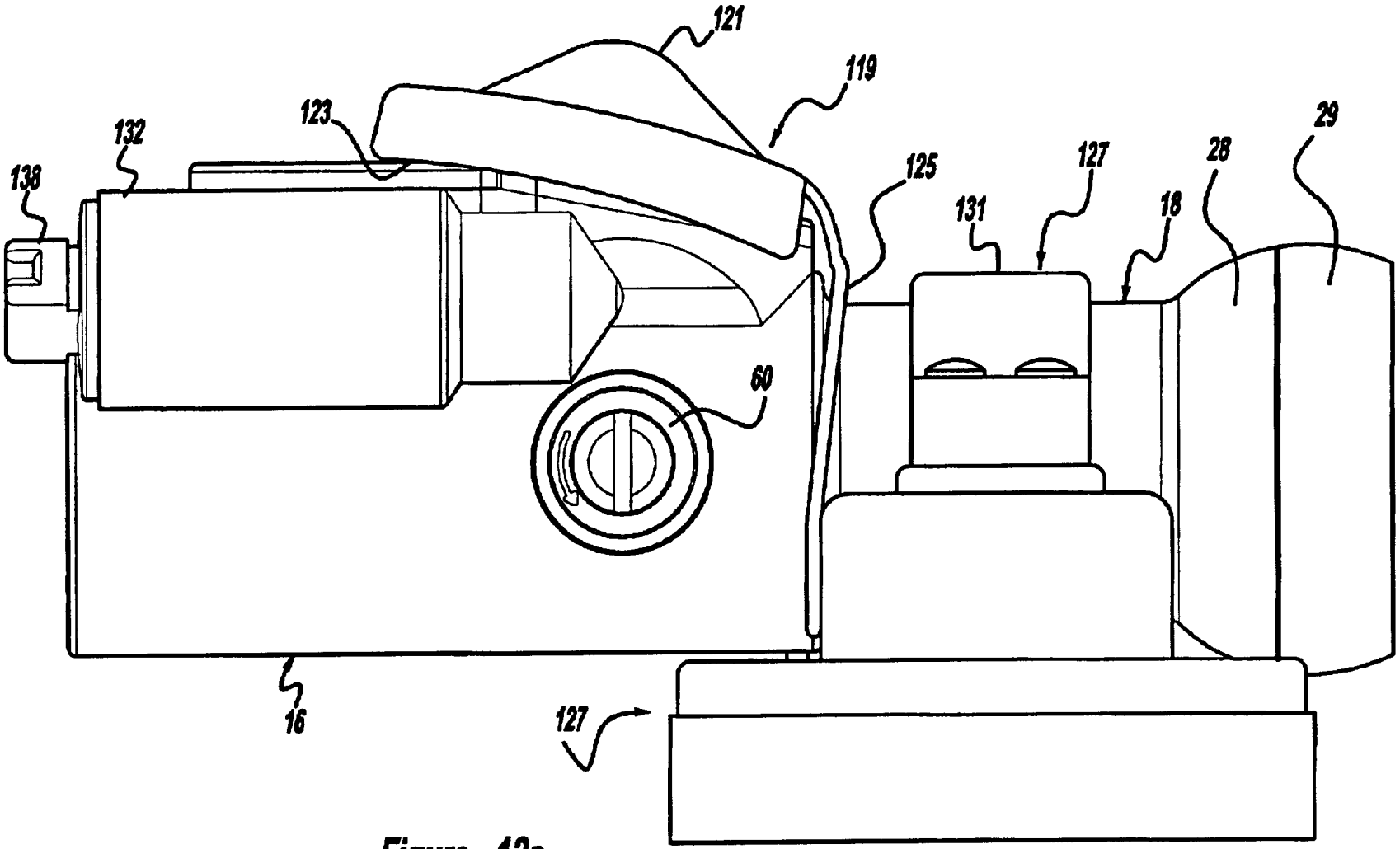
FIG. 12*a* is a side elevational, fragmentary view, with the cap, shown in phantom in FIG. 2, as located on the sighting device of FIGS. 1–8 with the sighting device shown on a scope mount for attachment to a rifle, and with a cup portion of the cap located over the ambient light collector to block any reflected light therefrom.
Figure 12B:
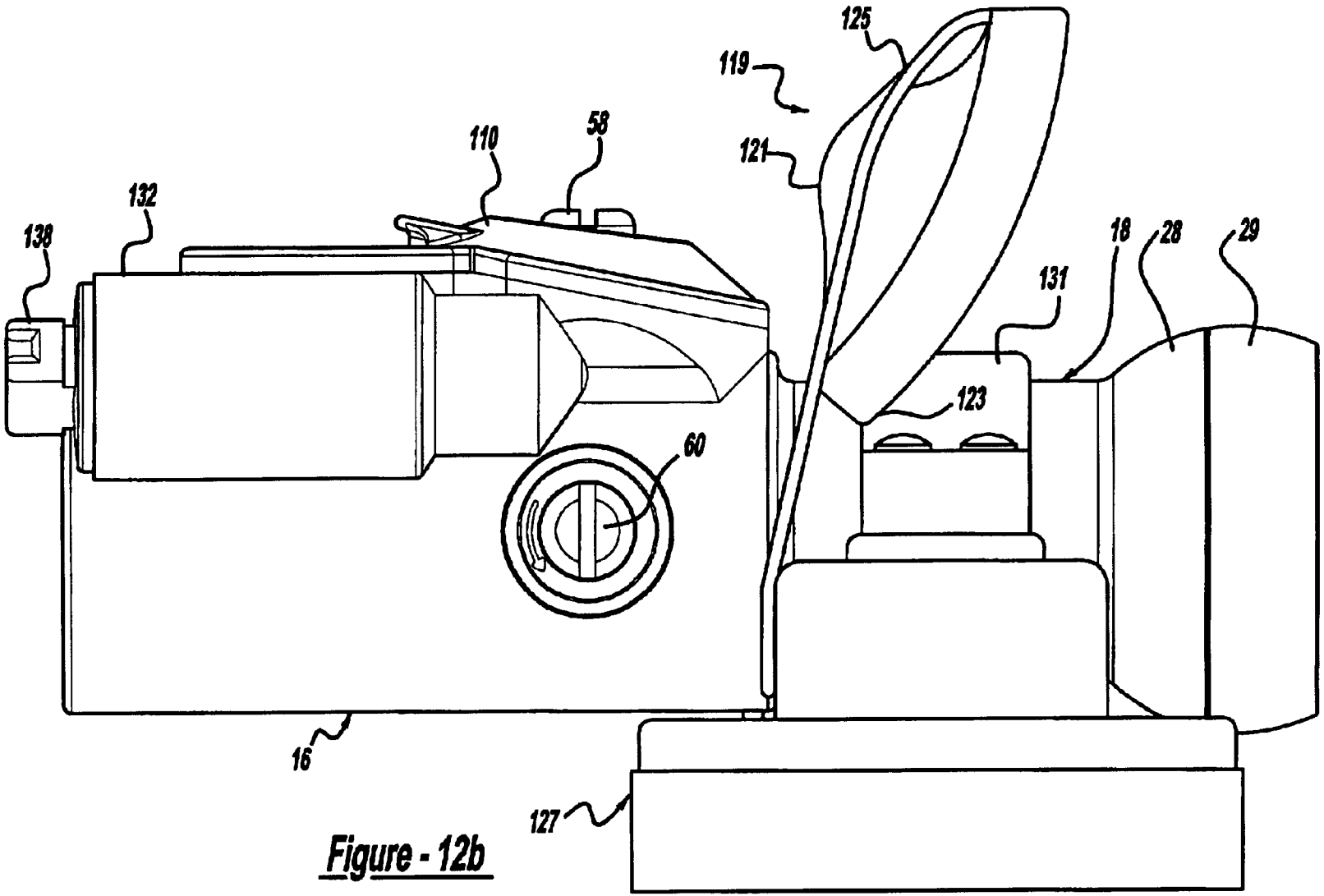
FIG. 12*b* is a side elevational view similar to FIG. 12*a* showing the cup portion inverted.
Figure 12C:
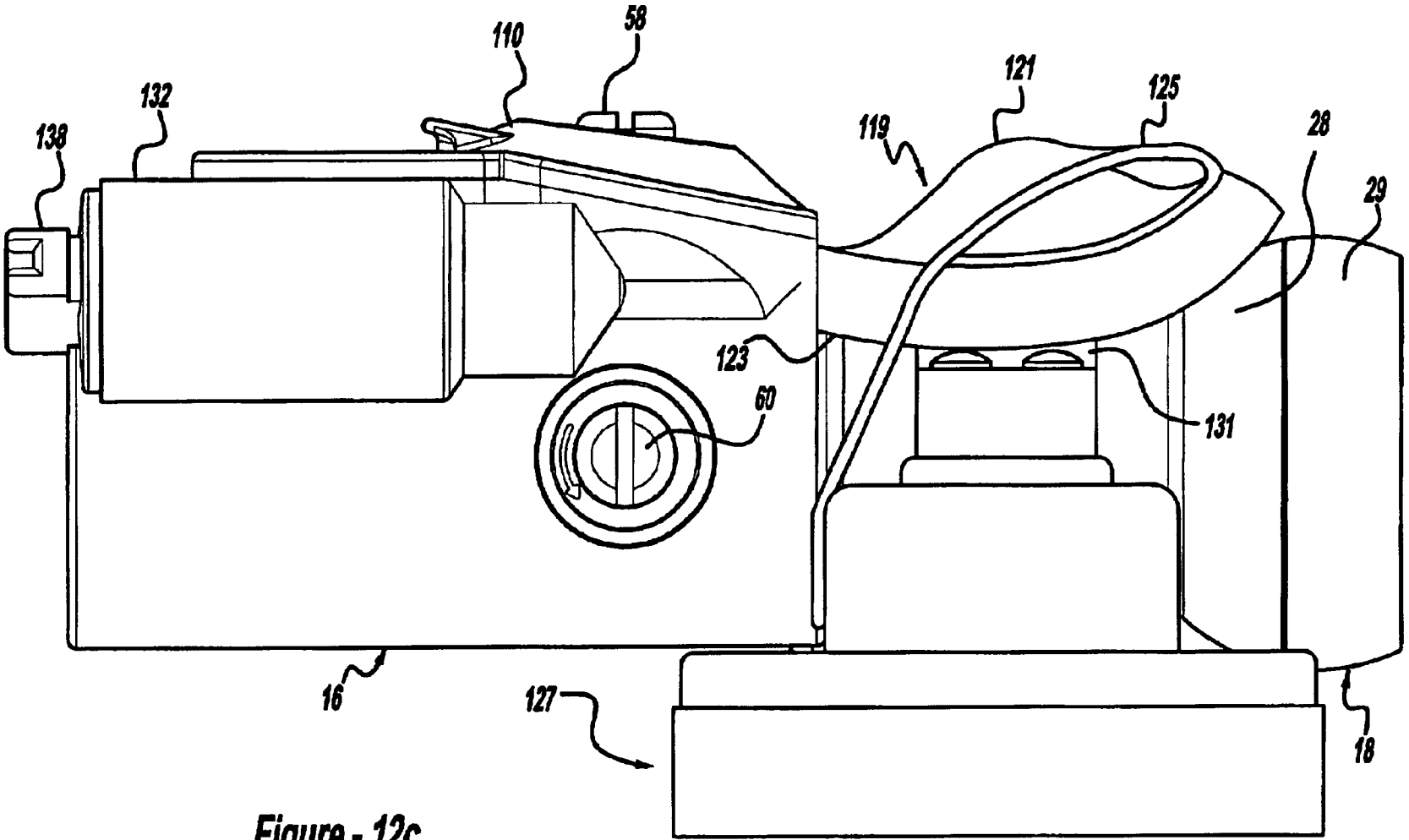
FIG. 12*c* is a side elevational view similar to FIG. 12*b* showing the cap with the cup portion supported on the sighting device in a position away from the ambient light collector.

Since the cap 119 may not be required with the embodiments of FIGS. 10 and 11 it is generally shown in phantom lines in FIG. 2 and in solid lines in FIGS. 12*a*–12*c*. In this regard the cap 119 would be made of an elastic material such as rubber or a resilient plastic to be readily fitted onto the cover 110.

The cap 119 includes a generally hemispherically, closed cup portion 121 which has a lip section 123 adapted to overengage the tab 118 to hold the cup portion 121 in place when in the closed position on the retainer cover 110. The cup portion 121 is integrally connected to an annular, elastic band 125 which can be readily stretched over the end cap assembly 29 for placement on and removal from the outer housing cylinder 18. The elastic band 125 also facilitates bending for pivotal movement of the cup portion 121 towards and away from the retainer cover 110. FIG. 12*a* shows the cap 119 with the cup portion 121 located over the retainer cover 110 whereby light into and out from the fiber optic collector 108 is blocked. Here the sighting device 10 is shown secured to a scope mount 127 (generally shown) with the outer housing cylinder 18 held there by an upper clamp member 131. If the operator desires to have the cap 119 on the outer housing cylinder 18 during daylight hours but not blocking the fiber optic light collector 108, the elastic band 125 can be stretched and the cup portion 121 can be located partially within the band 125 as shown in FIG. 12*b* with the elastic band 125 now over the top of the cup portion 121. Now the cap 119 can be pivoted forwardly moving the cup portion 121 onto the top of the outer housing cylinder 18 and over the upper clamp member 131 as shown in FIG. 12*c*. Here it is resiliently held partially against the upper clamp member 131 substantially out of blocking position relative to the fiber optic collector 108. Alternatively the cap 119, could be rotated to either side out of blocking alignment with the fiber optic collector 108. In this regard the cap 119 is initially assembled onto the outer housing cylinder 18 prior to assembling the sighting device 10 onto the scope mount 127.

As noted the fiber optic collector 108 is generally conically shaped and adapted to collect ambient light from overhead. It is believed that the conical contour will enable the fiber optic collector 108 to collect ambient light more multidirectionally than if it were planar. In this regard the forward section 120 of the collector 108 is angled forwardly substantially further downwardly than the rearward section 122 is angled rearwardly downwardly and thus will facilitate the collection of light from the scene of the target or object being viewed. See FIG. 7. In one form of invention the forward section 120 was inclined forwardly at an angle of inclination Al of around 11° relative to the sighting axis X—X. The rearward angle of inclination Al' of the rearward section 122 was around 8°. In this regard the forward section 120 of the collector 108 is also positioned to be transversely above the end cap assembly 29 to further facilitate the collection of light from the scene of the object being viewed. At the same time the transverse angulation of the conically shaped support dome 106 at its center will be at an angle At of around 30° with a horizontal plane. In this regard the retainer cover 110 is of a substantially transparent plastic material whereby ambient light can readily pass through into the fiber optic collector 108 and fits matingly onto the fiber optic collector 108. In one form of the invention the retainer cover 110 was made of a transparent or clear polycarbonate material such as that manufactured by General Electric and sold under the designation of Lexan QQ2220 with a refractive index of around 1.586. A thin silicone hard coating of around 0.00016 inches (0.004 mm) thick with a refractive index of around 1.43 can be applied to the outer surface of the cover 110 to protect it from the elements. At the same time, in one form of the invention, the main housing 16, including the support dome 106, was constructed of a black non-light reflecting thermo-plastic material such as that sold by General Electric Company under the designation Ultem 1000. In addition the main housing 16 is externally provided with a matte black finish.

As noted power sources other than the fiber optic collector 108 are utilized to provide illumination for the reticle. In one form of the invention as shown in FIG. 9, the fiber optic collector 108 has a transmission line portion 124 which is connected to the other power sources. The fiber optic collector 108 and the transmission line portion 124 are of an integral, one piece construction.

Thus in order to provide illumination for the reticle especially during night sighting the radio-luminescent source or tritium lamp 100 is optically connected to a segment of the fiber optic transmission line portion 124 within the housing assembly 14. As noted the tritium lamp 100 will provide a level of illumination for the reticle significantly lower than the maximum intensity provided by the fiber optic collector 108 at peak daylight sighting. Thus the tritium lamp 100 will be most effective in low light or dark lighting conditions. Thus as the intensity of ambient light decreases the desired degree of contrast between the intensity of illumination of the reticle and the illumination of the object will be automatically maintained. The tritium lamp 100 is substantially in contact with the proximate segment of the transmission line portion 124 for effective light transmission. However, as noted, a movable cover could be placed between the tritium lamp 100 and the confronting segment of the line portion 124 whereby the operator could selectively vary the magnitude of light transmitted into the transmission line portion 124 by the tritium lamp 100. In one form of the invention the tritium lamp 100 was of the type T-4734 manufactured and sold by M B Microtec.

Figure 13:
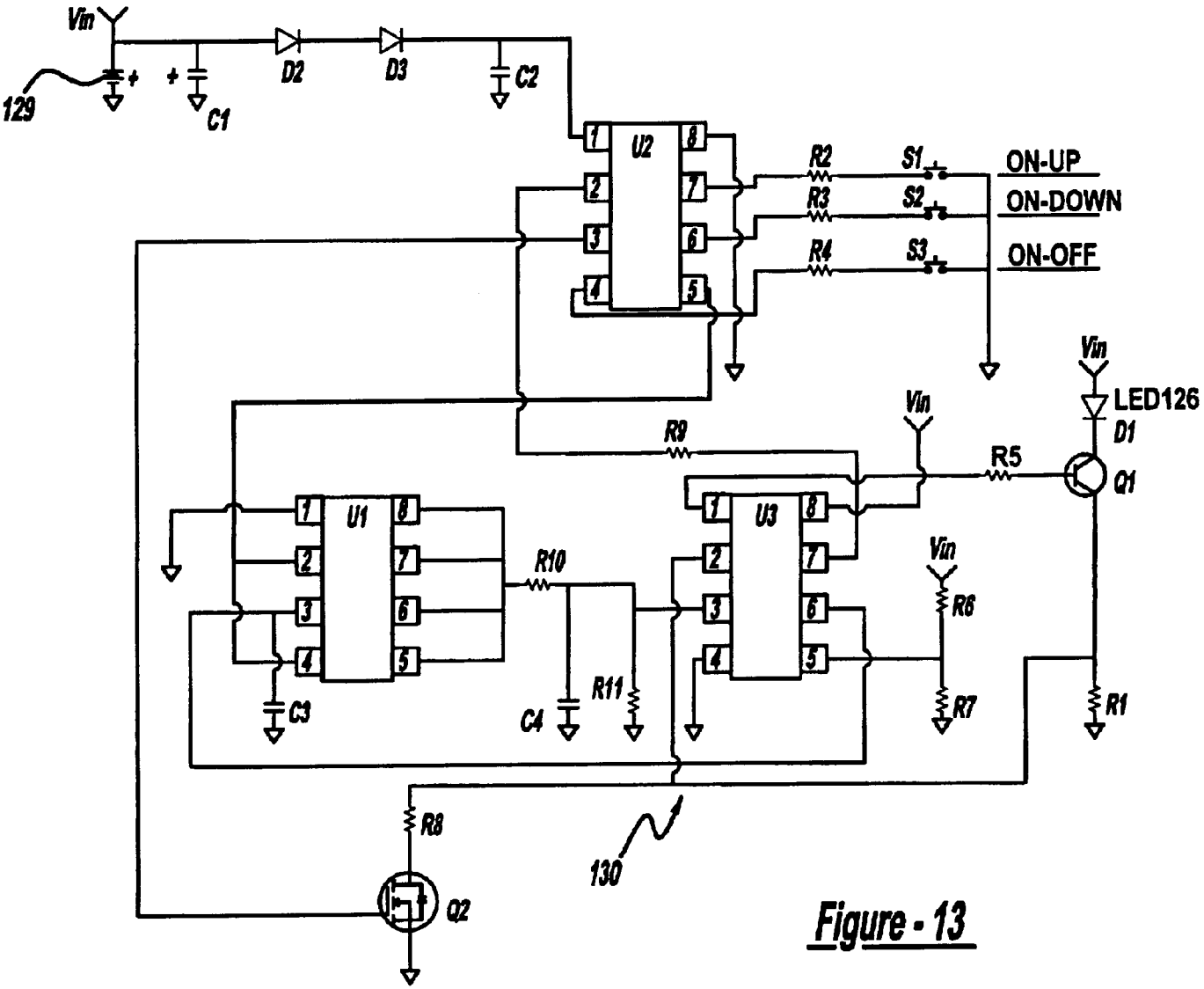
FIG. 13 is a schematic diagram depicting the control circuit for selectively controlling the illumination of the reticle by a light emitting diode (LED) from the battery supply.

The LED section 102 is also connected to the transmission line portion 124. Here the LED section 102 includes an LED (light emitting diode) 126 which is located in an LED reflector casing 128. The transmission line portion 124 extends through the LED reflector casing 128 proximate to the LED 126. See FIGS. 9*d* and 9*e*. The internal surface of the reflector casing 128 is coated with a reflective material whereby light emitted by the LED 126 which moves past the confronting segment of the line portion 124 in the casing 128 will be reflected back towards that transmission line segment to improve the efficiency of the light collected from the LED 126. In one form of the invention the reflector casing 128 was made of an ABS plastic with the internal surface coated with sputtered aluminum to provide the reflective coating. The LED 126 is energized by batteries 129 through a control circuit 130. The batteries 129 are located in a battery housing section 132 in the main housing 16. See FIGS. 1–3, 5, 8*a* and 8*b*. The control circuit 130, as generally shown in FIG. 13, can be mounted on a compact circuit board and located in the main housing 16 (see FIG. 7) and provides the operator with selective control of the actuation and the level of illumination of the LED 126 in a manner to be described. As noted the light system of the LED 126 while selectively actuable for use primarily in extreme bright conditions can also be selectively actuated in the event of a loss of intensity from the light system of the tritium lamp 100.

Figure 8A:
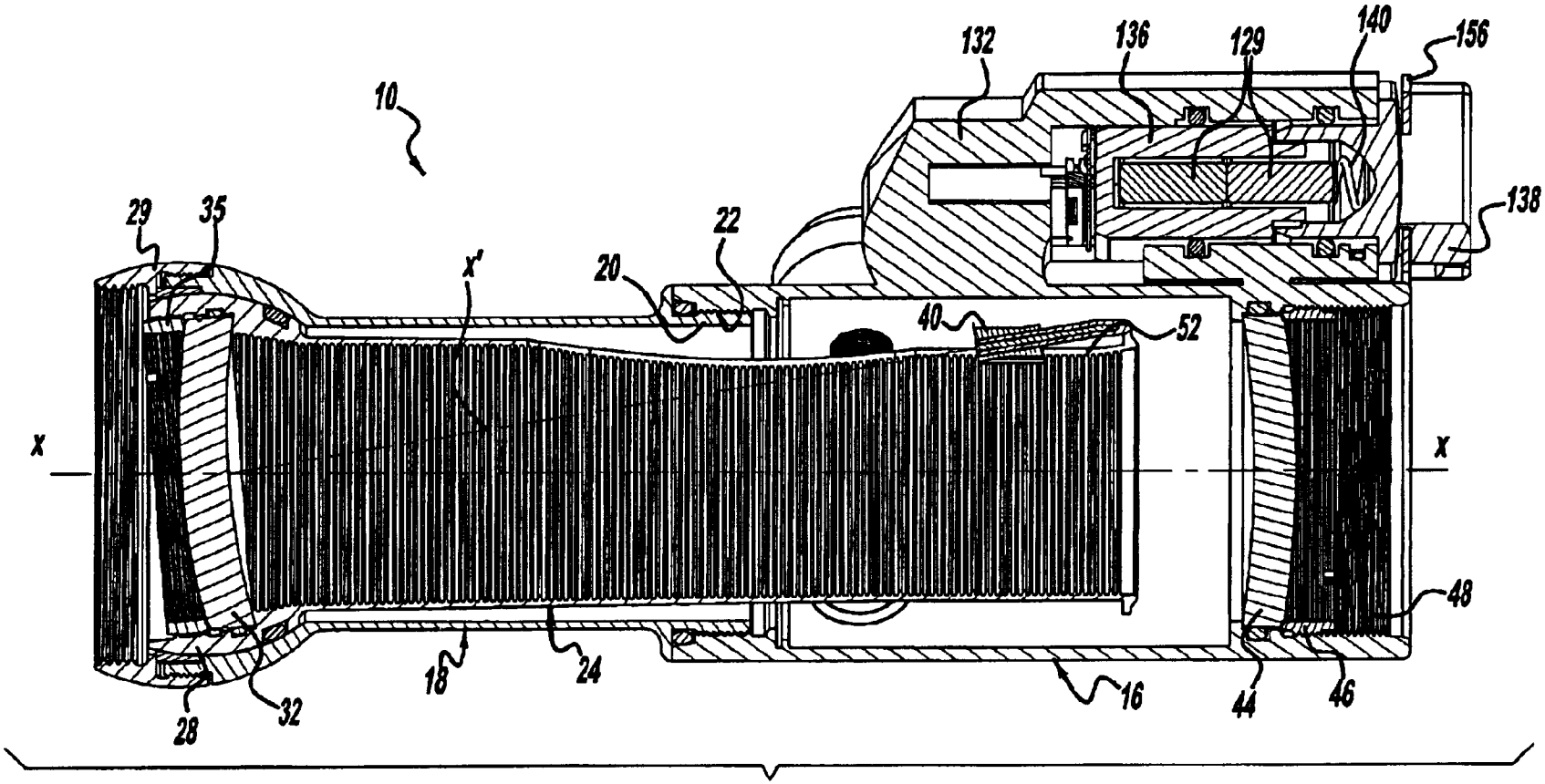
FIG. 8*a* is a transverse, longitudinal full sectional view of the sighting device of FIG. 1 taken generally in the direction of the Arrows 8*a*—8*a* in FIG. 8 and including the segment for energizing an LED for illuminating the reticle.
Figure 8B:
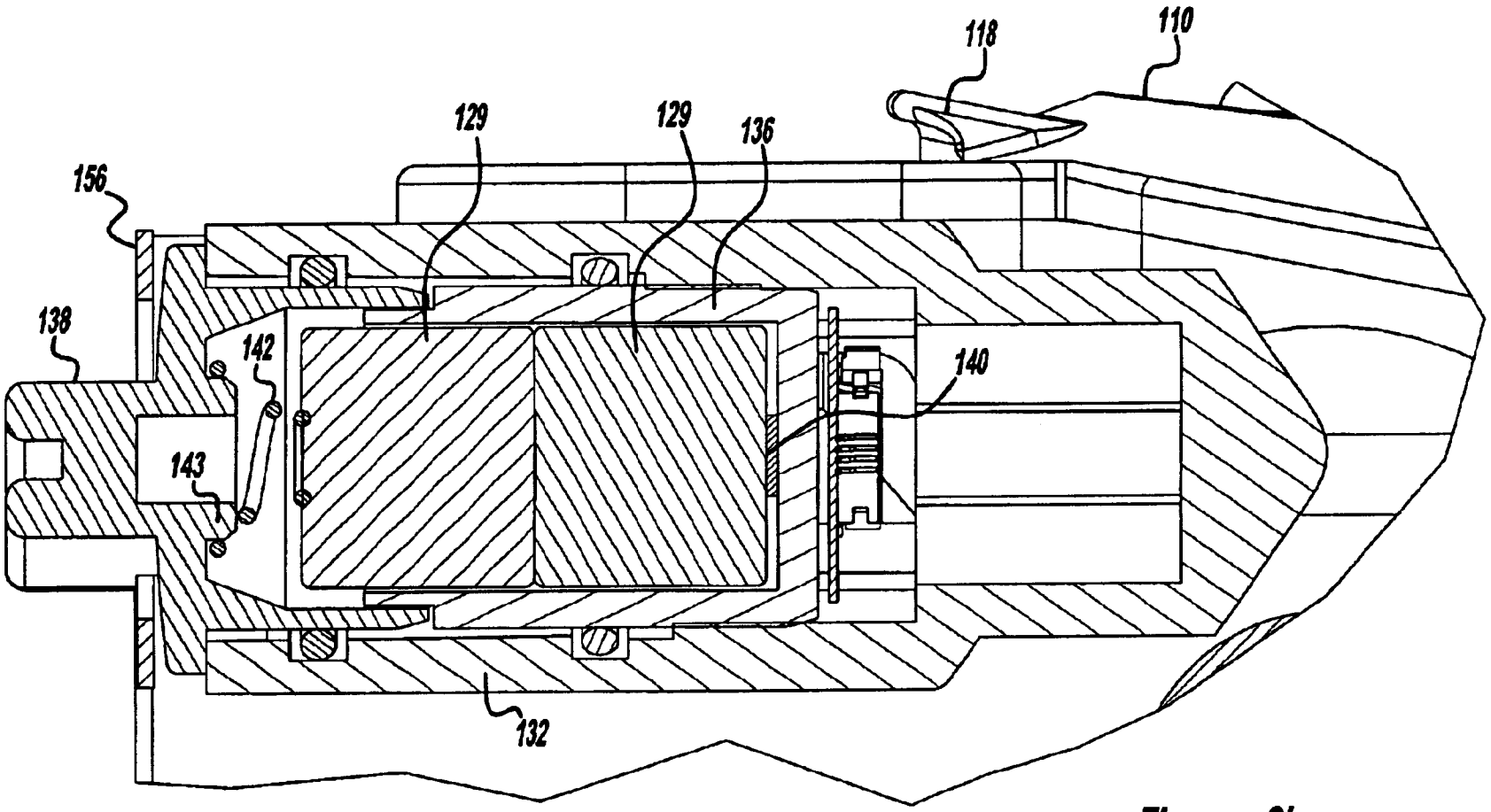
FIG. 8*b* is a fragmentary sectional view of the sighting device of FIG. 1 taken generally in the direction of the Arrows 8*b*—8*b* in FIG. 8 and depicting the battery section for energizing the LED.

Looking now to FIGS. 8*a* and 8*b*, the batteries 129 are located in an assembly 136 within the battery housing section 132. A removable cap 138 encloses the opening to the housing section 132 and biases the batteries 129, which are mounted in series, into operative engagement against an electrical circuit contact 140 via a conical steel or cylindrical elastomer spring 142. The spring 142 is held in place by a boss 143 located in the base of the spring. To fully deactivate the LED 126 and its related circuitry the cap 138 can be partially moved outwardly away from the spring 142 whereby the batteries 129 will be moved out of operative engagement from the circuit contact 140. Alternatively an on-off switch could be used.

The photochemical light source 104 is located in a light source housing section 134 in the main housing 16 somewhat diametrically opposite from the battery housing section 132. See FIGS. 1, 2, 4, 5 and 8*b*. A segment of the transmission line portion 124 is located in the light source housing section 134 in engagement or close proximity with the light source 104. See FIG. 8*b*. As will be seen the light source 104 is provided primarily for a back-up in the event of loss of sufficient illumination from the LED 126 as by a loss of power from the batteries 129.

The photochemical light source 104 can be in the form of a light stick which includes chemicals which are normally separated by a tube or wall in a capsule. To activate the light source or stick 104 the capsule is flexed or squeezed to break the inner tube or wall whereby the chemicals can be mixed with the reaction causing a glow of light. The light emission will last from around four to twelve hours after activation and will be transmitted into the segment of the transmission line portion 124 proximate to the light stick 104. In one form of the invention the light stick 104 can be a mini-type A Cyalume light stick manufactured by Omniglow Corporation.

Figure 8C:
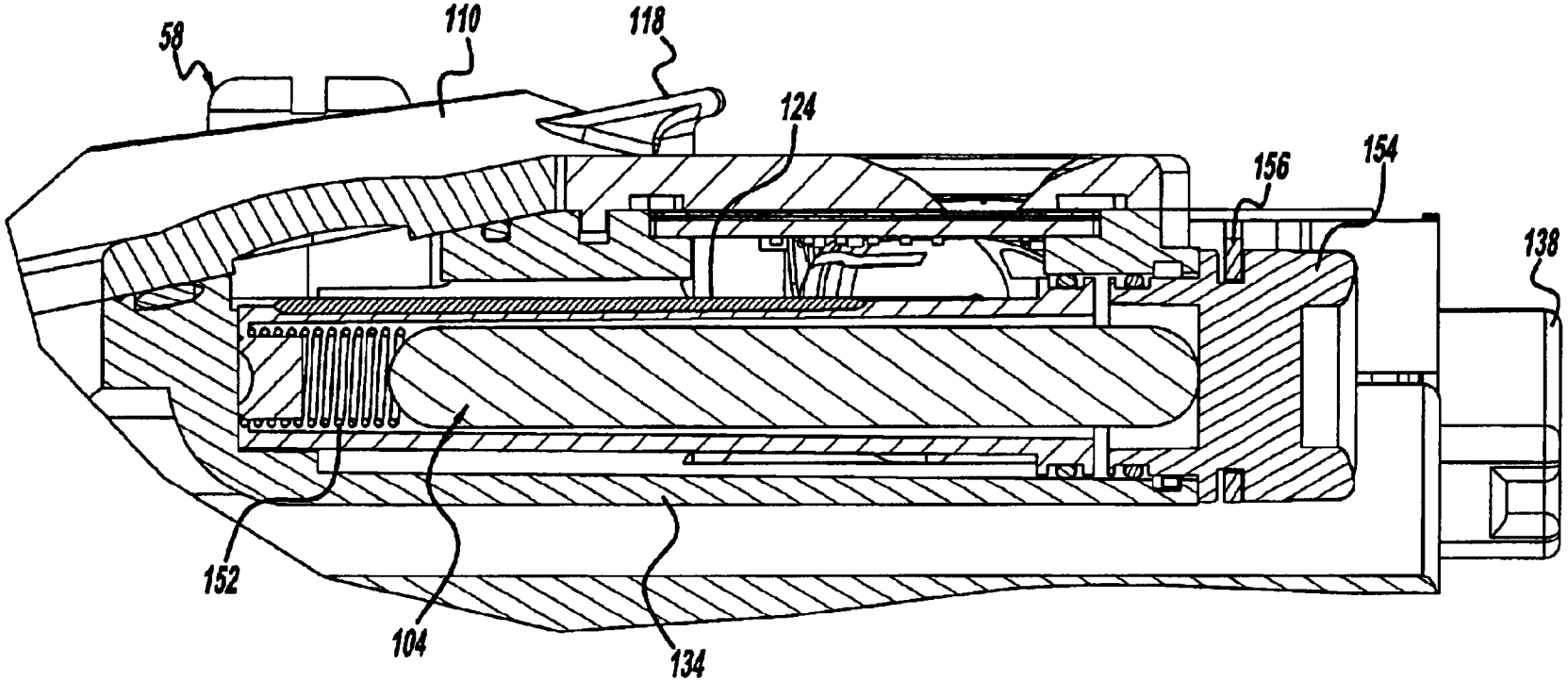
FIG. 8*c* is a fragmentary, transverse sectional view of a segment of the sighting device of FIG. 1 taken generally in the direction of the Arrows 8*c*—8*c* in FIG. 8 and depicting the photochemical light source for illuminating the reticle.

Looking now to FIG. 8*c*, the light stick 104 is held in the light source or light stick housing section 134 against the bias of a spring 152 by a removable cap 154 located in the rearward end of the light stick housing section 134. In the embodiment of FIG. 8*c* in order to activate the light stick 104, the operator first removes the cap 154 to take out the light stick 104. The operator then flexes the light stick 104 to break the inner tube or wall, and shakes it to facilitate mixing, whereby it will be actuated to create light and then be placed back into the housing section 134. It should be noted that an operable member externally actuable by the operator could be provided on the main housing 16 to flex and activate the light stick 104 without removal from the housing section 134.

As can be seen in FIGS. 1 and 2 the removable battery cap 138 and light stick cap 154 are connected to a flexile strap 156 which is secured to the main housing 16 by a centrally located cross pin 158 so that when the caps 138 and 154 are removed they will not fall loose and will be readily accessible for reinsertion.

As noted, the ambient light collector 108 and the tritium lamp 100 will be continuously activated to provide light to the transmission line portion 124 for illumination of the reticle. Of course, as previously noted, even the tritium lamp 100 could be manually controlled by the addition of a movable cover (not shown) and the light collector 108 could be deactuated by placing the cap 119 on the retainer cover 110. The LED 126, however, will be actuated only by manually operated electrical control by the operator. This is done by the control circuit 130 which is depicted in FIG. 13. The manual, remote control is performed through selective actuation of push button switches S1, S2 and S3 which are located in the upper, rearward portion of the main housing 16. See FIGS. 1–3. Actuation of any of the switches S1–S3 will actuate the control circuit 130. When switch S1 is actuated while the control circuit 130 is on, it will increase the intensity of light emitted from the LED 126 while when switch S2 is actuated while the control circuit 130 is on it will decrease the intensity. When switch S3 is actuated while the control circuit 130 is on, it will place the control circuit 130 in the off condition, and cease electrical actuation of the LED 126 but the control circuit 130 will then be placed in a sleep or memory mode which will be explained.

Now, assuming that the LED 126 is in the deactuated state, the operator can actuate the control circuit 130 to activate the LED 126 by simply pressing any button switch S1–S3. To increase the illumination the operator will press switch S1 and to decrease illumination will press switch S2. The control circuit 130 will provide a range of light intensity from the LED 126 from a minimum to a maximum in twenty predetermined steps. Thus, assuming that the intensity of the LED 126 is at the minimum level, the intensity can be increased in steps by pressing button switch S1. Each pressing of the button switch S1 will increase the intensity one step. This will be signaled to the operator by activation of the LED 126 to cause reticle blinking off and on once for each step. Thus the operator can observe and confirm each increase. Conversely, to decrease the intensity of the LED 126 the operator simply presses the button switch S2 with the decrease occurring in one step for each pressing. Again each incremental decrease will be signaled to the operator by the single off and on blink of the reticle for each step.

It has been determined that there is a substantial difference in light intensity between night viewing at low light and dark and day viewing between mid-light and bright. Thus two separate levels are set with steps 1–6 being operable for the night setting and steps 7–20 being operable for the day setting. To accommodate for this difference the illumination level obtained by the night setting will be dropped substantially from that for the day setting. Thus if the system is in the day setting mode and being decreased by button switch S2 when the level drops from day setting 7 to night setting 6 there will be a substantial decrease in illumination. Conversely an increase in setting by button switch S1 from night setting 6 to day setting 7 will result in a substantial increase in illumination. In this regard the increase or decrease in the separate steps 1–6 for night seting and steps 7–20 for day setting are not necessarily equal but are set to accommodate the different levels of brightness encountered.

However, in the event the LED 126 is at the maximum brightness level further pressing of the button switch S1 will not activate the LED 126 to cause reticle blinking. Likewise, further pressing of the button switch S2 will not activate the LED 126 to cause reticle blinking at the minimum brightness level.

Now in the event the operator decides to deactivate the LED 126, the button switch S3 will be pressed. When this happens the control circuit 130 will be placed in a deactuated, memory retention or sleep mode with the LED 126 de-energized or off. However, upon actuation of the LED 126 by pressing any switch S1–S3, the control circuit 130 will return the LED 126 back to the last intensity level before it was deactuated by the on-off switch S3.

The sleep or memory mode can provide substantial advantage to the operator under certain conditions. For example if the operator is in an environment in which the light level is such that the LED 126 would be used but there is no object to be sighted, the operator can preset the LED 126 to compensate for that condition and then place it in the sleep or memory mode. Now when an object to be sighted appears, the operator can now activate the LED 126 which will place it at or near the desired illumination level whereby adjustment by the operator is obviated or minimized and whereby aiming at the object will be facilitated.

In this regard it is believed that the provision of control circuitry to provide stepped variations in the intensity of an LED has been done. But it is believed that such increase or decrease has not been signaled by the blinking of the reticle for each step as noted and it is also believed that there has not been a memory retention or sleep mode with return to the last intensity level upon reactivation.

While the button switches S1, S2 and S3 are shown mounted on the main housing 16, it should be understood that other locations are possible. For example, for use with a rifle, the switches S1, S2 and S3 could be located in a pressure pad supported on the rifle near the trigger mechanism. Here the switches S1, S2 and S3 would be connected to the control circuit 130 by a cable. In some circumstances this could make actuation by the operator more convenient. In this regard, it can be seen that the remote electrical control of the illumination of the LED 126 is without question far superior to the use of a manually movable shield or cover to block more or less illumination from the LED 126 or other light source.

As noted the LED 126 is energized by the batteries 129 as applied through the control circuit 130. In the event that the batteries 129 reach a predetermined low voltage level upon initial actuation through button switches S1, S2 or S3 the control circuit 130 will cause the reticle to blink on and off ten times. This will signal the operator that the batteries 129 are nearing a level at which the control circuit 130 will be deactuated and hence control of intensity of the reticle will cease and that the batteries 129 should be replaced. However, after the ten blinks, the control circuit 130 can continue to operate for around one hour of constant actuation of the LED 126 when at the highest setting of illumination. By having such visual signal only for a limited time, continued use of the sighting device 10 is not inhibited. Once the batteries 129 reach the lowest operating level for the LED 126, the control circuit 130 will shut down. Such signaling of low battery level is believed to have been done.

As previously indicated while the batteries 129 are activated, the control circuit 130 will store in memory the last step level of illumination provided by the LED 126 and this will be done with a minimal amount of current. In the event the batteries 129 are deactivated, as by loosening the cap 138 or by their removal or loss of power, then the memory will be lost. After this condition when the batteries 129 are again activated or replaced if needed, the control circuit 130 will initially actuate the LED 126 at a preset level to about the lowest magnitude of daylight setting. This would be around step seven of the twenty steps. It should be understood, of course, that the level could still be reduced to the minimum step one intensity level by switch S2.

The control circuit 130 is generally shown in FIG. 12 and comprises standard components. Thus the circuit components include:

(1) a mosfet transistor U1,
(2) an integrated circuit, microcontroller U2,
(3) an integrated circuit, operational amplifier U3,
(4) the LED 126 (D1),
(5) an NPN transistor Q1,
(6) a mosfet transistor Q2,
(7) the batteries 129,
(8) diode rectifiers D2–D3,
(9) capacitors C1–C4,
(10) resistors R1–R11, and
(11) the switches S1–S3.

In the diagram of FIG. 13 the designations Vin indicate direct connection to the positive side of the batteries 129. At the same time those lead lines terminating in an arrow head indicate a common ground connection which is connected to the negative or ground side of the batteries 129.

Looking now to FIG. 13, the integrated circuit, microcontroller U2 is programmed to provide the basic operational features noted and as such is connected to switches S1, S2 and S3.

Thus the batteries 129 are connected to the microcontroller U2 at a Contact 1 via diodes D2 and D3 which reduce the voltage to a preselected level with capacitors C1 and C2 providing smoothing of the voltage magnitude.

The switches S1, S2 and S3 are connected to Contacts 7, 6 and 4, respectively, of the microcontroller U2 through resistors R2, R3 and R4, respectively. The opposite sides of switches S1, S2 and S3 are connected to ground. The resistors R2, R3 and R4 are provided to maintain the effective magnitude of the voltage as applied to the microcontroller U2 at a desired operative level.

Now the microcontroller U2 has an oscillator section which produces an oscillatory control signal at a preselected frequency. This oscillatory signal is transmitted from Contact 5 to Contacts 2 and 4 of the mosfet transistor U1. In this regard the oscillatory signal will provide a signal oscillating from a zero voltage to a substantially uniform maximum positive voltage. However, the microcontroller U2 is programmed to vary the time of the positive voltage relative to the zero voltage to thereby vary the average magnitude of the applied voltage and resultant current. Thus with each activation of the up switch S1 the relative time of the positive voltage component will be increased with the reverse being true with each activation of the down switch S2. The mosfet transistor U1 receives the oscillatory signal from Contact 5 of the microcontroller U2 into Contacts 2 and 4. The circuit of transistor U1 at Contact 4 is responsive to the high average voltage magnitudes while the circuit at Contact 2 is responsive to the low average voltage magnitudes. The output from mosfet transistor U1 is then connected to the integrated circuit, operational amplifier U3 at Contact 3. Resistors R10 and R11 and capacitor C4 serve to regulate and smooth the signals from transistor U1 to amplifier U3. The voltage of the batteries 129 is connected to the operational amplifier U3 via Contact 8.

Now the LED 126 is connected to the NPN transistor Q1 with the voltage of the batteries 129 connected to the positive side of the LED 126. The output from the operational amplifier U3 at Contact 1 is connected to the NPN transistor Q1 via resistor R5 which places the magnitude of applied voltage within the operating range of transistor Q1. Here the transistor Q1 will be oscillated off and on by the signal whereby the magnitude of average current though the LED 126 will be controlled to coincide with the desired selected magnitude of brightness as set by the microcontroller U2. The output through the transistor Q1 is connected to ground via resistor R1. A second circuit connecting the NPN transistor Q1 to ground is through resistor R8 and mosfet transistor Q2. The resistor R8 is of a substantially lesser magnitude than resistor R1. The transistor Q2 in turn is controlled by a signal from Contact 3 of the microcontroller U2. Now for night setting the microcontroller U2 will not activate transistor Q2 and the current through the LED 126 will pass through the resistor R1 of high magnitude whereby the range of brightness from steps 1–6 will be low. Now for actuation of the LED 126 for daylight setting in the brightness range of steps 7–20 the microcontroller U2 when in that range will activate transistor Q2 whereby the current through transistor Q1 can now also complete the circuit for LED 126 through the substantially lower resistance path of resistor R8. Thus this will provide the significant increase in current and illumination from LED 126 for daylight setting relative to night setting.

The operational amplifier U3 also senses the magnitude of voltage of batteries 192 via the voltage divider of resistors R6 and R7 connected to Contact 5. Now when the magnitude of voltage of batteries 129 drops to a predetermined low value the amplifier U3 will send a signal from its Contact 7 to the Contact 2 of the microcontroller U2 whereby it will provide the ten blink signal of the reticle to signal the operator that the batteries 129 should be replaced shortly. As noted, however, this signal occurs when the batteries 129 will still have a reasonable life expectancy.

Also the microcontroller U2 has a memory section whereby upon turning U2 off via switch S3 the last level of illumination will be stored in memory. Now when the microcontrolled U2 is activated by pressing any one of switches S1–S3 the LED 126 will be initially illuminated at the last level.

In one form of the invention the mosfet transistor U1 was made by International Rectifier under Part No. IRF507, the micro-controller U2 was made by Microchip under Part No. PIC12LC508A-041/SN, operational amplifier U3 was made by Maxim under Part No. MAX951EUA, transistor Q1 was an NPN type made by Zetex under Part No. FMMT491TA and transistor Q2 was a mosfet transistor made by Zetex under Part No. ZXM61NOZF. The batteries 129 where three volts each to provide six volts when connected in series. The LED 126 was of a type made by Ledtronics, Inc. under part number BP280CWAG6K-3.5Vf-050T. The control circuit 130 as described above will be the same for each of the different assembly of light sources 95, 95*a* and 95*b* of FIGS. 9–11.

The control circuit 130 can be of numerous forms to perform the noted control functions of the intensity of the LED 126.

It should be noted that the control circuit 130 could be modified such that off-switch S3 could be eliminated and the off condition provided when up-switch S1 and down-switch S2 are simultaneously activated.

Figure 9A:
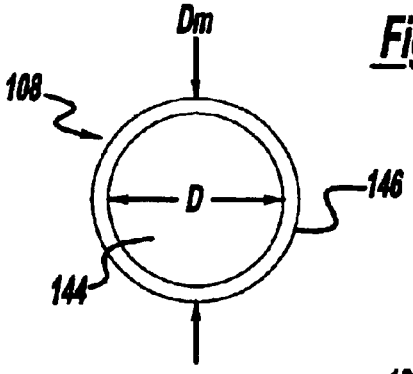
FIG. 9*a* is an end view, to enlarged scale, of the optical fiber for the collector section and transmission line portion of the ambient light collector taken in the direction of the Arrows 9*a*—9*a* in FIG. 9.
Figure 9B:
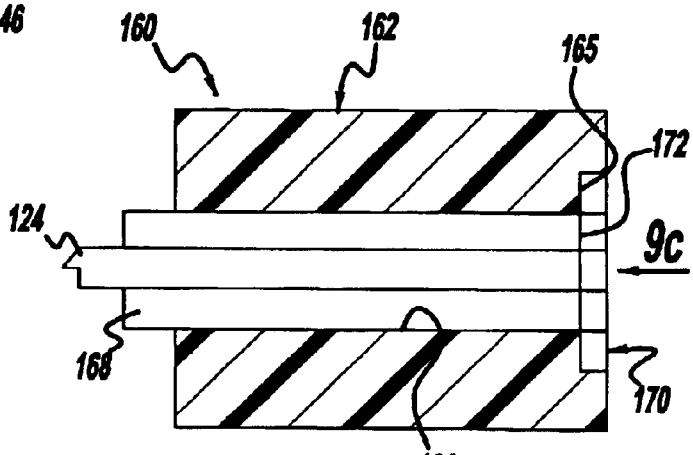
FIG. 9*b* is a sectional view to enlarged scale depicting the end of the transmission line of the ambient light collector located in a mask structure for defining the reticle pattern and taken generally in the direction of the Arrows 9*b*—9*b* in FIG. 9.
Figure 9C:
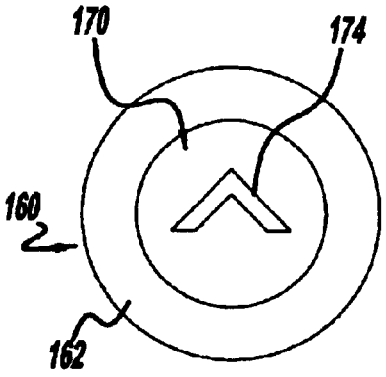
FIG. 9*c* is an end view of the mask structure of FIG. 9*b* taken generally in the direction of the Arrow 9*c* in FIG. 9*b* and depicting one form of a reticle image.
Figure 9D:
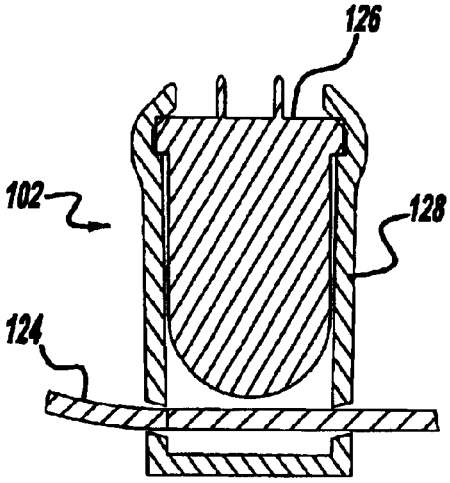
FIG. 9*d* is a sectional view through the light emitting diode and a reflector casing parallel to the segment of the transmission line portion located therein.
Figure 9E:
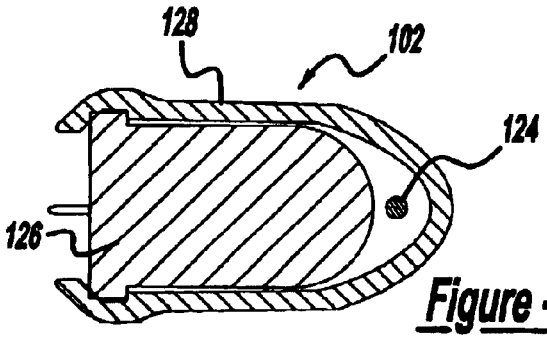
FIG. 9*e* is a sectional view through the light emitting diode and a reflector casing taken transversely through the segment of the transmission line portion passing therethrough.

Looking now to FIG. 9*a* the fiber optic collector 108 and the associated transmission line portion 124 are constructed of an optical fiber having a core portion 144 and an outer cladding 146. It has been common to form the reticle pattern simply by providing a fiber optic line with an end face having the desired contour. Such contours have been in the form of a circular dot, a diamond, a square, etc. In other instances the reticle pattern has been formed by providing a mask with an aperture or opening of desired contour over the end face of the fiber optic line having a circular contour. Such constructions are shown in the '034 Patent noted above. In some prior art devices, where a light emitting diode is placed behind a reticle mask consisting of a through bore, the aiming mark is not sharp, but is observed in the dichroic mirror to have a starburst and generally imprecise shape and outline. This is caused in part where an air space or gap occurs between the light emitting die end of the light emitting diode and reticle mask and/or the end of the fiber optic and reticle mask which allows light to scatter. This can be avoided by the construction as shown in FIGS. 9*b* and 9*c*. A mask structure 160 includes an outer fiber bushing 162 having a through bore 164 terminating at a planar end surface 165 of the bushing 162. The end segment 166 of the transmission line portion 124 is supported in a fiber tubing 168 which in turn is matingly located in the through bore 164 of the bushing 162. A flat, planar mask 170 is secured to the planar end surface 165 of bushing 162 and over the end of through bore 164 with the planar end surface 172 of transmission line end segment 166 in mating engagement. The mask 170 is formed with an aperture having the desired reticle pattern. As noted the pattern can have numerous configurations such as a dot, a triangle, a square, a chevron etc. A desired reticle pattern is shown in FIG. 9*c* where the mask 170 has an aperture with a chevron reticle pattern 174. The chevron pattern has an upper pointed peak which assists in the accuracy of aiming. As noted in the '034 Patent, masks for direct use with a fiber optic line have been made of a flat glass element. Even here there could be some slight misalignment between the end, engaging surface of the fiber optic line and the relatively rigid glass mask. In the present invention, the mask 170 is made of a thin flexible metal plate for attachment to the planar end surface 165 of bushing 162 whereby mating alignment with the planar end surface 172 of the transmission line end segment 166 is more readily attained. In one form of the invention the mask 170 was made of a copper plate with a thin layer of nickel plating on the outer surface. Both the inner copper surface and outer nickel surface are blackened to avoid reflection of light. In one form, the copper plate had a thickness of around 0.020 inches with the nickel plating having a thickness of around 0.0010 inches. The mask 170 could be secured to the end surface 165 of bushing 162 by tabs, flanges or other means. Also in one form of the invention the fiber bushing 162 and fiber tubing 168 were made of a polyethelene material.

Looking now to FIG. 9*a*, the fiber optic collector 108 and integral transmission line portion 124 is constructed of an optical fiber preferably made with a core portion 144 constructed of a pigmented fluorescent polystyrene material having a refractive index of around 1.60 and with an outer cladding 146 of a clear acrylic material having a refractive index of around 1.40.

With the core portion 144 of the fiber optic of the collector 108 and transmission line portion 124 made of a colored or pigmented fluorescent fiber, the ambient light which is directed into the fiber optic collector 108 will excite the fluorescent material to generate light for illuminating the reticle pattern. In one form of the invention the diameter D of the core portion 144 of the optic fiber was around 0.024 inches (0.61 mm) while the major diameter Dm of the optic fiber was around 0.0255 inches (0.65 mm). A suitable fiber material can be generally of the type manufactured and sold by Bicron Business Unit of Saint-Gobain Industrial Ceramics, Inc.

It has been desirable to provide the reticle pattern as viewed by the operator to be red, yellow or amber or orange. In the embodiment of FIG. 9, the fiber optic light collector 108 and transmission line portion 124 are pigmented to provide red or amber light. A red fluorescent fiber can be such as the Bicron BCF-99-172 model while the amber or orange fiber could be the Bicron BCF-99-06A model. The LED 126 was selected to emit a green hue when used with the red fiber optic and a blue hue when used with the amber fiber optic. The tritium lamp 100 was selected to emit a green hue. The light stick 104 was selected such that when activated it emits a yellow hue. The final hue of the reticle, however, is determined primarily by the hue or color of the fiber optic.

The construction described above serves to efficiently provide a reticle pattern of a desired size for the chosen focal length of the dichroic mirror, lens 32. In a preferred embodiment of the present invention, the focal length of the dichroic mirror, lens 32 was around 3.00 inches (76.2 mm). By the application of calculations through methods known to those skilled in the art, it was determined that a suitable reticle dot size of 6.5 MOA (minutes of angle) will be subtended on the target or scene being viewed at the dichroic mirror, lens 32.

With the first assembly 95 of light sources as shown there can be some light from the LED 126 transmitted back into the fiber optic light collector 108 whereby it would be illuminated. This could then be observable from a remote location whereby the presence of the operator could be detected especially during night sighting. As noted this can be prevented by simply putting the cap 119 over the retainer cover 110.

FIG. 10 depicts a second assembly of light sources 95*a* modified from that of FIG. 9. In the discussion which follows elements similar to like elements in the assembly 95 of FIG. 9 have been given the same numeral designation with the addition of the letter postscript "a" and unless described otherwise can be considered to be the same.

Thus the light sources of FIG. 10 include an ambient light collector section 98*a* having a fiber optic light collector 108*a* which is integral with a transmission line portion 124*a*, a tritium lamp 100*a*, an LED 126*a* and a light stick 104*a*. These are the same as their similarly numbered counterparts in FIG. 9. Here, however, the LED 126*a* is not located in a reflector casing, such as casing 128, but is directly connected to a clear fiber optic connector line 184 for transmission of light when activated.

Figure 10A:
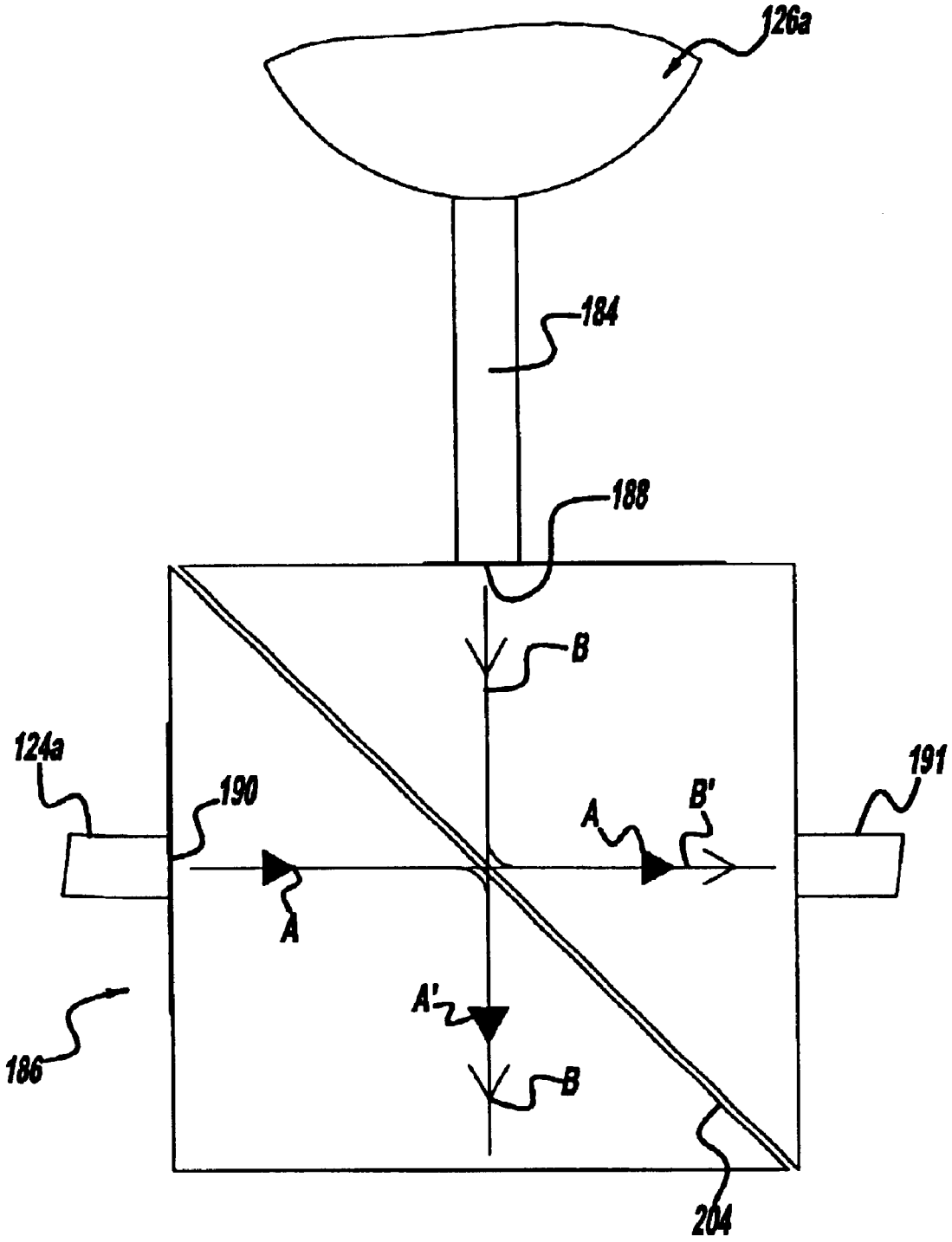
FIG. 10*a* is an enlarged view of the portion of the apparatus in FIG. 10 including a beam splitter taken generally in the Circle 10*a* in FIG. 10.

In this embodiment, the output from the LED 126*a* is connected to a beam splitter prism 186 at a first input 188 via a clear fiber optic connector line 184. At the same time, the fiber optic light collector 108*a* is connected by the transmission line portion 124*a* to a second input 190 to the prism 186 transverse to the first input 188. As can be seen in FIG. 10*a* the light from the light collector 108*a* and tritium lamp 100*a*, and, when activated, the light stick 104*a* will be transmitted into the beam splitter prism 186 at the second input 190 along a line A with part of the light being transmitted through the prism 186 at the first input 188 along the line A and part reflected transversely along line A'. Similarly the light from the LED 126*a* will be transmitted into the prism 186 along a line B transversely to line A and with part reflected along a line B' in line with the line A. The output from the beam splitter prism 186 along lines A and B' will be transmitted by a clear fiber optic transmitter line 191. The transmitter line 191 in turn is then connected to a mask structure 160*a* which is the same as mask structure 160 for illumination of the reticle defined by the mask structure 160*a*. Here, however, a red LED 126*a* will be used with a red fiber optic and/or an amber LED 126*a* will be used with an amber or orange fiber optic.

In one form of the invention, the beam splitter prism 186 can be of a generally 70/30 or 50/50 type or other form depending upon the coating placed on the mating 45° angulated surfaces 204. Thus when of the 70/30 type 70% of the red or amber light from the transmission line portion 124*a* will be transmitted to transmitter line 191 along line A and 30% will be reflected along line A'. Similarly 30% of the red or amber light from LED 126*a* through connector line 184 will be reflected into the transmitter line 191 along line B' and 70% will be passed through along line B. The 50/50 type will provide 50% pass through and 50% reflection.

In this case substantially no light will be transmitted back to the light collector 108*a* by the LED 126*a* and thus a cap, such as cap 119, may not be necessary. In this regard it should be noted that the light intensity from the light stick 104 when actuated and from the tritium lamp 100 will be substantially less than that from the LED 126*a* at its mid to upper brightness range and thus there would be minimal light reflected back into the fiber optic collector 108 from the light stick 104, when activated, and the tritium lamp 100.

FIG. 11 depicts a third assembly of light sources 95*b* with an arrangement of the multiple sources of light modified from that of FIGS. 9 and 10. In the discussion which follows elements similar to like elements in the assembly 95 of FIG. 9 have been given the same numeral designation with the addition of the letter postscript "b" and unless described otherwise can be considered to be the same.

Thus the light sources of FIG. 11 include an ambient light collector section 98*b* having a fiber optic light collector 108*b* which is integral with a transmission line portion 124*b*, a tritium lamp 100*b*, an LED 126*b* and a light stick 104*b*. These are the same as their similarly numbered counterparts in FIG. 9. Here, however, the LED 126*b* is not located in a reflector casing, such as casing 128, but is directly connected to a clear fiber optic connector line 184*b* for transmission of light when activated.

In this embodiment, the outputs from the LED 126*b* and transmission line portion 124*b* are connected to a fiber coupling or mixing rod 192. There the light transmitted in the line portion 124*b* and connector line 184*b* are combined and transmitted to a mask structure 160*b* by a clear fiber optic transmitter line 194. As noted the mask structure 160*b* is the same as mask structure 160.

The mixing rod or coupling 192 can be of a type made by Micropol Fiberoptic AB. Here the line portion 124*b* and connector line 184*b* are joined together to transmit the light to the transmitter line 194. Again in this case a red LED 126*b* will be used with a red fiber optic and/or an amber LED 126*b* will be used with an amber or orange fiber optic.

Here again, substantially no light will be transmitted back to the light collector 108*b* by the LED 126*b* and thus a cap, such as cap 119, may not be necessary.

As noted, the intensity of light transmitted by the tritium lamp such as 100, 100*a* and 100*b* could be selectively varied by a manually movable shield (not shown) for movement between the tritium lamp 100*b* and fiber optic transmission line portion 124*b*.

It should be noted that in some sighting devices the use of the three sources of illumination, i.e. the fiber optic collector 108, the tritium lamp 100 and LED section 102 could be advantageously used without the light stick 104. In this regard it should also be understood that different combinations of the noted structures could be advantageously used. Also, it can be seen that certain unique structural features can be considered to stand alone.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A sighting device for day and night use for viewing a scene or object along a sighting axis, comprising:

reticle structure means for providing a reticle pattern for use in aiming said sighting device;

a first source of light being a means for receiving ambient light;

a second source of light being a source of electrically powered artificial light;

control means for selectively controlling the magnitude of illumination from said second source of light by varying the magnitude of electrical energy utilized;

said first source of light comprising light collector means including a fiber optic light collector defined by a first optical fiber having a preselected length and adapted to receive light directed inwardly into said first optical fiber over said preselected length to provide a determinable level of illumination to said reticle structure means for providing a desired level of brightness for said reticle pattern for a desired contrast with the level of illumination of the image or object being viewed;

a fiber optic line operatively connected with said fiber optic light collector and having a light emitting end;

said fiber optic light collector providing illumination to said light emitting end through said fiber optic line;

fiber optic means connected with said second source of light for providing illumination to said light emitting end through said fiber optic line;

and beam-splitting means comprising a dichroic mirror operative for reflecting wavelengths of light over a first range and for transmitting wavelengths over a second range; said dichroic mirror having a central axis generally located in line with the sighting axis whereby the scene or object is viewed through said dichroic mirror;

said reticle structure receiving illumination from said light emitting end within said first range of wavelengths and projecting said reticle pattern onto said dichroic mirror to produce a reflected image of said reticle pattern superimposed on the image or object being viewed.

2. The sighting device of claim 1 including a third source of light being a radio-luminescent artificial light source;

said fiber optic means connected to said third source of light for providing illumination to said light emitting end through said fiber optic line.

3. The sighting device of claim 1 with said reticle structure including a mask having said reticle pattern with said mask connected to said light-emitting end of said fiber optic line for being illuminated from said light-emitting end.

4. The sighting device of claim 1 with said second source of light being an electrically powered light emitting diode.

5. The sighting device of claim 1 including another source of light being a photochemical light source being selectively actuable by the operator to create illumination;

said fiber optic means connected to said other source of light for providing illumination to said light emitting end through said fiber optic line when actuated.

6. The sighting device of claim 1 including a third source of light being a radio-luminescent artificial light source;

said fiber optic means connected to said third source of light for providing illumination to said light emitting end through said fiber optic line, and a fourth source of light being a photochemical light source being selectively actuable by the operator to create illumination;

said fiber optic means connected to said fourth source of light for providing illumination to said light emitting end through said fiber optic line when actuated.

7. The sighting device of claim 1 with said fiber optic light collector being defined by a generally conical arrangement of said first optical fiber and located generally on an upper surface of said sighting device.

8. The sighting device of claim 1 with said first and second sources of light being adapted to transmit light over a selected range of wavelengths for a preselected hue;

a beam splitter-prism structure adapted to transmit a selected first percentage of said range of wavelengths for said preselected hue and to reflect the remainder of a second percentage transversely;

said beam splitter-prism structure being connected to said fiber optic line for providing illumination to said light emitting end;

one of said first and second sources of light connected to said beam splitter-prism for transmission of said first percentage to said fiber optic line for illumination of said light emitting end, the other of said first and second sources of light connected for reflection of said second percentage to said fiber optic line for illumination of said light emitting ending.

9. The sighting device of claim 8 with said beam splitter-prism structure substantially inhibiting transmission of light from said second source of light back into said light collector means.

10. The sighting device of claim 1 with said fiber optic means including a first fiber optic transmission line connected to transmit illumination from said first source of light and a second fiber optic transmission line connected to transmit illumination from said second source of light;

a mixing rod structure connecting said first and second fiber optic transmission lines and directing the combined illumination from each into said fiber optic line for illumination of said light emitting end.

11. The sighting device of claim 10 with said mixing rod structure substantially inhibiting transmission of light from said second source of light back into said light collector means.

12. A sighting device for viewing a scene or object, comprising:

reticle structure means for providing a reticle pattern for use in aiming said sighting device;

ambient light source means for receiving ambient light and for providing illumination from the ambient light to said reticle structure means for illuminating said reticle pattern;

said ambient light source means comprising a fiber optic light collector defined by a first optical fiber having a preselected length and adapted to receive light directed inwardly into said first optical fiber over said preselected length to provide a determinable level of illumination to said reticle structure means for providing a desired level of brightness for said reticle pattern for a desired contrast with the level of illumination of the scene or object being viewed;

fiber optic means operatively connected with said ambient light source means for transmitting the light obtained from said fiber optic light collector to said reticle structure means;

beam-splitting means for transmitting light waves over a first range of wavelengths and reflecting light waves over a second range of wavelengths and adapted to receive the scene or object being viewed and to transmit the scene or object with light in said first range of wavelengths;

said ambient light source means and said fiber optic means operative for transmitting light of a wavelength in said second range of wavelengths;

said reticle structure means receiving illumination from said fiber optic means and projecting said reticle pattern onto said beam-splitting means to produce a reflected image of said reticle pattern within said second range of wavelengths superimposed on the scene or object being viewed and being transmitted by said beam splitting means within said first range of wavelengths;

said fiber optic light collector being defined by a generally conical arrangement of said first optical fiber and located generally at the upper side of the sighting device.

13. The sighting device of claim 12 with said reticle pattern being reflected along a sighting axis of said sighting device, said conical arrangement having an axially forward facing inclined section and an axially rearward facing inclined section, said forward facing section of said conical arrangement being at an angle of inclination relative to said sighting axis substantially greater than the angle of inclination relative to said sighting axis of said rearward facing inclined section.

14. The sighting device of claim 12 with said reticle pattern being reflected along a sighting axis of said sighting device, said conical arrangement having an axially forward facing inclined section and an axially rearward facing inclined section, said forward facing section of said conical arrangement being at an angle of inclination relative to said sighting axis substantially greater than the angle of inclination relative to said sighting axis of said rearward facing inclined section; said angle of inclination of said forward facing section being around 11° and said angle of inclination of said rearward facing section being around 8°.

15. The sighting device of claim 14 with the angulation at each side of the section transverse to said forward and rearward facing sections at the center of said conical arrangement being around 30°.

16. The sighting device of claim 12 including a second source of light being a source of electrically powered artificial light;

said fiber optic means operatively connected with said second source of light for transmitting the light therefrom to said reticle structure means for illumination of said reticle pattern;

control means for selectively controlling the magnitude of illumination from said second source of light to said reticle structure means by varying the magnitude of electrical energy utilized;

a cap operatively connected to said sighting device and being selectively actuable by the operator to cover said fiber optic light collector to block emission therefrom of any illumination received by said fiber optic light collector from said second source of light through said fiber optic means.

17. The sighting device of claim 12 including a second source of light being a source of electrically powered artificial light;

said fiber optic means operatively connected with said second source of light for transmitting the light therefrom to said reticle structure means for illumination of said reticle pattern;

control means for selectively controlling the magnitude of illumination from said second source of light to said reticle structure means by varying the magnitude of electrical energy utilized;

a cap operatively connected to said sighting device and being selectively actuable by the operator to cover said fiber optic light collector to block emission therefrom of any illumination received by said fiber optic light collector from said second source of light through said fiber optic means;

said sighting device including a main cylindrical housing and an outer housing cylinder connected to and extending axially forwardly from said main cylinder housing, connecting means supporting said beam-splitting means substantially at the outer axially forward end of said outer housing cylinder;

said cap being constructed of an elastic material and having a cup portion of a generally conical configuration to fit matingly over said conical arrangement of said fiber optic light collector;

said cap further including an elastic annular band adapted to fit matingly and resiliently on said outer housing cylinder to hold said cap onto the sighting device with said cup portion being selectively movable by the operator to overengage said fiber optic light collector;

said cup portion being selectively movable by the operator whereby said cup portion can be moved elastically by said annular band to an axially forward position on said outer housing cylinder at a lowered position away from said fiber optic light collector and with said elastic band located over said cup portion.

18. A sighting device for day and night use for viewing a scene or object along a sighting axis, comprising:

reticle structure means for providing an illuminated reticle pattern for use in aiming said sighting device;

a source of light being a source of electrically powered artificial light;

control means for selectively controlling the magnitude of illumination from said source of light by varying the magnitude of electrical energy utilized;

a fiber optic line operatively connected with said source of light and having a light emitting end for providing illumination to said reticle structure means for illumination of said reticle pattern;

fiber optic means connected with said source of light for providing illumination to said light emitting end through said fiber optic line;

said control means including a manually actuable member for permitting the operator to increase or decrease the intensity of illumination from said source of light in preselected steps to similarly increase or decrease the intensity of the reticle pattern;

said control means providing a variation of said reticle pattern whereby the operator can visually discern each selected step of change of intensity as actuated by the operator.

19. The sighting device of claim 18 with said visual variation being an off-on blink of said reticle pattern.

20. The sighting device of claim 18 with said control means being selectively operable by the operator to an on condition for actuating said source of light to provide illumination to said reticle structure and to an off condition for deactuating said source of light from providing illumination to said reticle structure;

said control means including a memory structure for retaining the level of illumination provided by said source of light prior to being placed in the off condition and for initiating the same level of illumination when upon return to said on condition.

21. A sighting device for day and night use for viewing a scene or object along a sighting axis, comprising:

reticle structure means for providing an illuminated reticle pattern for use in aiming said sighting device;

a source of light being a source of electrically powered artificial light;

control means for selectively controlling the magnitude of illumination from said source of light by varying the magnitude of electrical energy utilized;

a fiber optic line operatively connected with said source of light and having a light emitting end for providing illumination to said reticle structure means for illumination of said reticle pattern;

fiber optic means connected with said source of light for providing illumination to said light emitting end through said fiber optic line;

said control means including a manually actuable member for permitting the operator to increase or decrease the intensity of illumination from said source of light;

said control means being selectively operable by the operator to an on condition for actuating said source of light to provide illumination to said reticle structure and to an off condition for deactuating said source of light from providing illumination to said reticle structure;

said control means including a memory structure for retaining the level of illumination provided by said source of light prior to being placed in the off condition and for initiating the same level of illumination upon return to said on condition.

22. The sighting device of claim 21 with said control means including a manually actuable member for permitting the operator to increase or decrease the intensity of illumination from said source of light in preselected steps, said control means providing a visual variation of said reticle structure whereby the operator can visually discern each selected step of change of intensity as actuated by the operator; said visual variation being an off-on blink of said reticle pattern.

23. The sighting device of claim 21 with said source of electrically powered artificial light being a light emitting diode;

said light emitting diode located in a substantially enclosed casing;

said fiber optic line extending through said casing with a receiving section of said fiber optic line being inside said casing in confrontation with said light emitting diode to receive illumination therefrom;

said casing having a reflective coating on its inner surface for reflecting light from said light emitting diode not initially engaging said receiving section for reflection back into said receiving section to increase the level of illumination received from said light emitting diode.

24. A sighting device for day and night use for viewing a scene or object along a sighting axis, comprising:

reticle structure means for providing a reticle pattern for use in aiming said sighting device;

a first source of light being a source of electrically powered artificial light;

control means for selectively controlling the magnitude of illumination from said first source of light by varying the magnitude of electrical energy utilized;

a second source of light being a radio-luminescent light source;

a fiber optic line having a light emitting end;

fiber optic means connected with said first and second sources of light for providing illumination to said light emitting end through said fiber optic line;

and beam-splitting means comprising a dichroic mirror operative for reflecting wavelengths of light over a first range and for transmitting wavelengths over a second range; said dichroic mirror having a central axis generally located in line with the sighting axis whereby the scene or object is viewed through said dichroic mirror;

said reticle structure receiving illumination from said light emitting end within said first range of wavelengths and projecting said reticle pattern onto said dichroic mirror to produce a reflected image of said reticle pattern superimposed on the image or object being viewed.

25. The sighting device of claim 24 with said control means including a manually actuable member for permitting the operator to increase or decrease the intensity of illumination from said source of light in preselected steps;

said control means providing a visual variation of said reticle structure whereby the operator can visually discern each selected step of change of intensity as actuated by the operator.

26. The sighting device of claim 25 with said visual variation being an off-on blink of said reticle pattern.

27. The sighting device of claim 24 with said control means including a manually actuable member for permitting the operator to increase or decrease the intensity of illumination from said source of light;

said control means being selectively operable by the operator to an on condition for actuating said source of light to provide illumination to said reticle structure and to an off condition for deactuating said source of light from providing illumination to said reticle structure;

said control means including a memory structure for retaining the level of illumination provided by said source of light prior to being placed in the off condition and for initiating the same level of illumination upon return to said on condition.

28. The sighting device of claim 27 with said control means including a manually actuable member for permitting the operator to increase or decrease the intensity of illumination from said source of light in preselected steps;

said control means providing a variation of said reticle structure whereby the operator can visually discern each selected step of change of intensity as actuated by the operator;

said visual variation being an off-on blink of said reticle pattern.

29. A sighting device for day and night use for viewing a scene or object along a sighting axis, comprising:

reticle structure means for providing a reticle pattern for use in aiming said sighting device;

a first source of light being a source of electrically powered artificial light;

control means for selectively controlling the magnitude of illumination from said first source of light by varying the magnitude of electrical energy utilized;

a second source of light being a photochemical light source being selectively actuable by the operator to create illumination;

a fiber optic line operatively connected with said fiber optic light collector and having a light emitting end;

fiber optic means connected with said first and second sources of light for providing illumination to said light emitting end through said fiber optic line;

and beam-splitting means comprising a dichroic mirror operative for reflecting wavelengths of light over a first range and for transmitting wavelengths over a second range; said dichroic mirror having a central axis generally located in line with the sighting axis whereby the scene or object is viewed through said dichroic mirror;

said reticle structure receiving illumination from said light emitting end within said first range of wavelengths and projecting said reticle pattern onto said dichroic mirror to produce a reflected image of said reticle pattern superimposed on the image or object being viewed.

30. The sighting device of claim 29 with said control means including a manually actuable member for permitting the operator to increase or decrease the intensity of illumination from said source of light in preselected steps;

said control means providing a visual variation of said reticle structure whereby the operator can visually discern each selected step of change of intensity as actuated by the operator.

31. The sighting device of claim 30 with said visual variation being an off-on blink of said reticle pattern.

32. The sighting device of claim 31 with said control means including a manually actuable member for permitting the operator to increase or decrease the intensity of illumination from said source of light;

said control means being selectively operable by the operator to an on condition for actuating said source of light to provide illumination to said reticle structure and to an off condition for deactuating said source of light from providing illumination to said reticle structure;

said control means including a memory structure for retaining the level of illumination provided by said source of light prior to being placed in the off condition and for initiating the same level of illumination upon return to said on condition.

33. The sighting device of claim 29 with said control means including a manually actuable member for permitting the operator to increase or decrease the intensity of illumination from said source of light;

said control means being selectively operable by the operator to an on condition for actuating said source of light to provide illumination to said reticle structure and to an off condition for deactuating said source of light from providing illumination to said reticle structure;

said control means including a memory structure for retaining the level of illumination provided by said source of light prior to being placed in the off condition and for initiating the same level of illumination upon return to said on condition.

34. A sighting device for day and night use for viewing a scene or object along a sighting axis, comprising:

reticle structure means for providing an illuminated reticle pattern for use in aiming said sighting device;

a source of light being a source of electrically powered artificial light;

control means for selectively controlling the magnitude of illumination from said source of light by varying the magnitude of electrical energy utilized;

a fiber optic line operatively connected with said source of light and having a light emitting end for providing illumination to said reticle structure means for illumination of said reticle pattern;

fiber optic means connected with said source of light for providing illumination to said light emitting end through said fiber optic line;

said control means including a manually actuable member for permitting the operator to increase or decrease the intensity of illumination from said source of light;

said source of light located in a substantially enclosed casing;

said fiber optic line extending through said casing with a receiving section of said fiber optic line being inside said casing in confrontation with said source of light to receive illumination therefrom;

said casing having a reflective coating on its inner surface for reflecting light from said source of light not initially engaging said receiving section for reflection back into said receiving section to increase the level of illumination received from said source of light.

35. The sighting device of claim 34 with said control means being selectively operable by the operator to an on condition for actuating said source of light to provide illumination to said reticle structure and to an off condition for deactuating said source of light from providing illumination to said reticle structure.

36. The sighting device of claim 34 with said source of light being a light emitting diode.

37. A sighting device for day and night use for viewing a scene or object along a sighting axis, comprising:

reticle structure means for providing a reticle pattern for use in aiming said sighting device;

a first source of light being a means for producing light;

a second source of light being a source of electrically powered artificial light;

control means for selectively controlling the magnitude of illumination from said second source of light by varying the magnitude of electrical energy utilized;

a fiber optic line having a light emitting end;

fiber optic means connected with said first and second sources of light for providing illumination to said light emitting end through said fiber optic line;

and beam-splitting means comprising a dichroic mirror operative for reflecting wavelengths of light over a first range and for transmitting wavelengths over a second range; said dichroic mirror having a central axis generally located in line with the sighting axis whereby the scene or object is viewed through said dichroic mirror;

said reticle structure receiving illumination from said light emitting end within said first range of wavelengths and projecting said reticle pattern onto said dichroic mirror to produce a reflected image of said reticle pattern superimposed on the image or object being viewed.

38. The sighting device of claim 37 with said second source of light being an electrically powered light emitting diode.

39. The sighting device of claim 37 with said first and second sources of light being adapted to transmit light over a selected range of wavelengths for a preselected hue;

a beam splitter-prism structure adapted to transmit a selected first percentage of said range of wavelengths for said preselected hue and to reflect the remainder of a second percentage transversely;

said beam splitter-prism structure being connected to said fiber optic line for providing illumination to said light emitting end;

one of said first and second sources of light connected to said beam splitter-prism for transmission of said first percentage to said fiber optic line for illumination of said light emitting end, the other of said first and second sources of light connected for reflection of said second percentage to said fiber optic line for illumination of said light emitting ending.

40. The sighting device of claim 37 with said control means including a manually actuable member for permitting the operator to increase or decrease and intensity of illumination from said second source of light in preselected steps to similarly increase or decrease the intensity of the reticle pattern;

said control means providing a visual variation of said reticle pattern whereby the operator can visually discern each selected step of change of intensity as actuated by the operator.

41. The sighting device of claim 40 with said visual variation being an off-on blink of said reticle pattern.

42. The sighting device of claim 37 with said control means being selectively operable by the operator to an on condition for actuating said source of light to provide illumination to said reticle structure and to an off condition for deactuating said source of light from providing illumination to said reticle structure;

said control means including a memory structure for retaining the level of illumination provided by said source of light prior to being placed in the off condition and for initiating the same level of illumination when upon return to said on condition.

43. The sighting device of claim 37 with said fiber optic means including a first fiber optic transmission line connected to transmit illumination from said first source of light and a second fiber optic transmission line connected to transmit illumination from said second source of light;

a mixing rod structure connecting said first and second fiber optic transmission lines and directing the combined illumination from each into said fiber optic line for illumination of said light emitting end.

44. The sighting device of claim 43 with said first source of light being a means for receiving ambient light and including light collector means, said mixing rod structure substantially inhibiting transmission of light from said second source of light back into said light collector means.

45. The sighting device of claim 37 including a battery supply for providing the electrical power for said second source of light;

said control means including a switch means selectively actuable to an on condition for connecting said battery supply for providing the electrical power to said second source of light and to an off condition for disconnecting said battery supply from said second source of light, said control means sensing the magnitude of voltage available from said battery and in the event a magnitude of voltage is sensed indicating the need for replacement of said battery supply prior to its voltage magnitude being below an operative level said control means providing a visual signal of limited duration to the operator each time said switch means is actuated to an on condition.

46. The sighting device of claim 42 including a battery supply for providing the electrical power for said second source of light;

said control means including a switch means selectively actuable to an on condition for connecting said battery supply for providing the electrical power to said second source of light and to an off condition for disconnecting said battery supply from said second source of light, said control means sensing the magnitude of voltage available from said battery and in the event a magnitude of voltage is sensed indicating the need for replacement of said battery supply prior to its voltage magnitude being below an operative level said control means providing a visual signal of limited duration to the operator each time said switch means is actuated to an on condition.

47. A sighting device for viewing a scene or object, comprising:

reticle structure means for providing a reticle pattern for use in aiming said sighting device;

a first source of light being an ambient light source means for receiving ambient light and for providing illumination from the ambient light to said reticle structure means for illuminating said reticle pattern;

said ambient light source means comprising a fiber optic light collector defined by a first optical fiber having a preselected length and adapted to receive light directed inwardly into said first optical fiber over said preselected length to provide a determinable level of illumination to said reticle structure means for providing a desired level of brightness for said reticle pattern for a desired contrast with the level of illumination of the scene or object being viewed;

fiber optic means operatively connected with said ambient light source means for transmitting the light obtained from said fiber optic light collector to said reticle structure means;

beam-splitting means for transmitting light waves over a first range of wavelengths and reflecting light waves over a second range of wavelengths and adapted to receive the scene or object being viewed and to transmit the scene or object with light in said first range of wavelengths;

said ambient light source means and said fiber optic means operative for transmitting light of a wavelength in said second range of wavelengths;

said reticle structure means receiving illumination from said fiber optic means and projecting said reticle pattern onto said beam-splitting means to produce a reflected image of said reticle pattern within said second range of wavelengths superimposed on the scene or object being viewed and being transmitted by said beam splitting means within said first range of wavelengths;

a second source of light being a radio-luminescent artificial light source;

said fiber optic means connected to said second source of light for providing illumination to said light emitting end through said fiber optic line; and a third source of light being a photochemical light source being selectively actuable by the operator to create illumination;

said fiber optic means connected to said third source of light for providing illumination to said light emitting end through said fiber optic line when actuated.

48. The sighting device of claim 47 with said fiber optic light collector being defined by a generally conical arrangement of said first optical fiber and located generally on an upper surface of said sighting device.

* * * * *